US006779865B2

(12) United States Patent
Shibata et al.

(10) Patent No.: US 6,779,865 B2
(45) Date of Patent: Aug. 24, 2004

(54) INK JET PRINTING METHOD AND APPARATUS

(75) Inventors: Tsuyoshi Shibata, Kanagawa (JP); Noribumi Koitabashi, Kanagawa (JP); Masataka Yashima, Tokyo (JP); Hitoshi Tsuboi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 384 days.

(21) Appl. No.: 09/941,596

(22) Filed: Aug. 30, 2001

(65) Prior Publication Data

US 2002/0054180 A1 May 9, 2002

(30) Foreign Application Priority Data

Sep. 1, 2000 (JP) ..... 2000-266159

(51) Int. Cl.[7] ..... B41J 29/393; B41J 2/21

(52) U.S. Cl. ..... 347/19; 347/43

(58) Field of Search ..... 347/19, 43, 14, 347/41, 42, 23, 17, 10, 37, 16

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 4,907,013 A | * | 3/1990 | Hubbard et al. | 347/19 |
| 5,581,284 A | * | 12/1996 | Hermanson | 347/43 |

FOREIGN PATENT DOCUMENTS

| | | | | |
|---|---|---|---|---|
| EP | 0 863 004 A2 * | 3/1998 | | 347/43 |
| JP | 59-123670 | 7/1984 | | |
| JP | 59-138461 | 8/1984 | | |

* cited by examiner

*Primary Examiner*—Hai Pham
*Assistant Examiner*—Charles W. Stewart, Jr.
(74) *Attorney, Agent, or Firm*—Fitzpatrick, Cella, Harper & Scinto

(57) ABSTRACT

An ink jet printing method and apparatus using a color ink and a print performance improving ink which minimizes an image quality degradation due to blank lines formed by failed or faulty nozzles. This system enables the use of a print head even with failed or faulty nozzles by minimizing the image quality degradation and extends the life of the print head before replacement. The print performance improving ink is deliberately ejected onto a blank line or its vicinity to produce the so-called primer effect, thereby inducing the color ink dots on the lines adjoining the non-ejecting nozzle line to spread into the blank line to make the blank line undistinguishable.

12 Claims, 19 Drawing Sheets

1ST PASS

2ND PASS

NON-EJECTING NOZZLE LINE

NON-EJECTING NOZZLE LINE

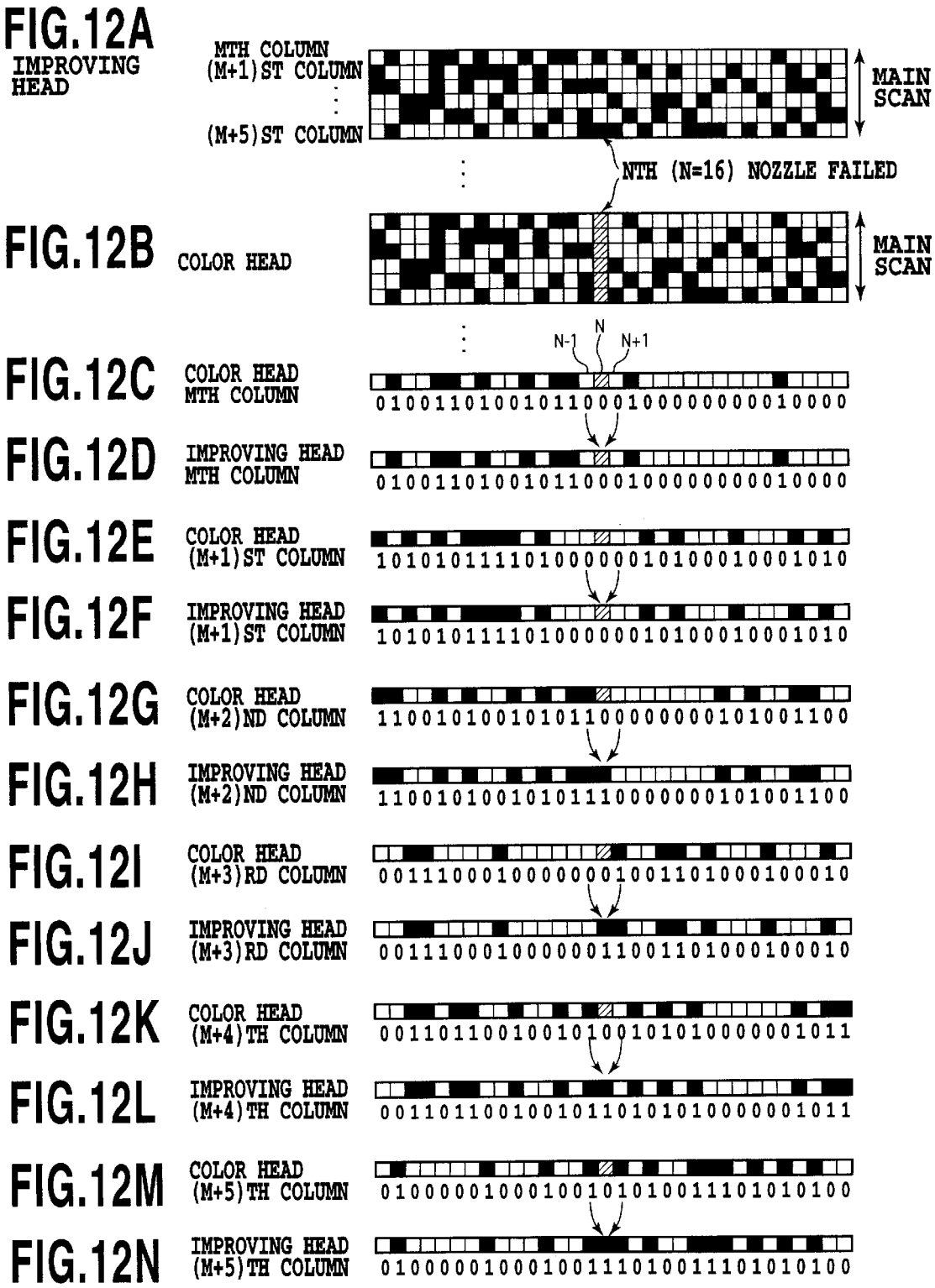
FIG.12A
IMPROVING HEAD
MTH COLUMN
(M+1)ST COLUMN
(M+5)ST COLUMN
MAIN SCAN
NTH (N=16) NOZZLE FAILED
FIG.12B
COLOR HEAD
MAIN SCAN
N-1
N
N+1
FIG.12C
COLOR HEAD MTH COLUMN
0100110100101100010000000000010000
FIG.12D
IMPROVING HEAD MTH COLUMN
0100110100101100010000000000010000
FIG.12E
COLOR HEAD (M+1)ST COLUMN
1010101111010000001010001000101 0
FIG.12F
IMPROVING HEAD (M+1)ST COLUMN
1010101111010000001010001000101 0
FIG.12G
COLOR HEAD (M+2)ND COLUMN
1100101001010110000000010100110 0
FIG.12H
IMPROVING HEAD (M+2)ND COLUMN
1100101001010111000000010100110 0
FIG.12I
COLOR HEAD (M+3)RD COLUMN
0011100010000000100110100010 0 10
FIG.12J
IMPROVING HEAD (M+3)RD COLUMN
0011100010000001100110100010 0 10
FIG.12K
COLOR HEAD (M+4)TH COLUMN
0011011001001010010101000000 1011
FIG.12L
IMPROVING HEAD (M+4)TH COLUMN
0011011001001011010101000000 1011
FIG.12M
COLOR HEAD (M+5)TH COLUMN
0100000100010010101001110101 0100
FIG.12N
IMPROVING HEAD (M+5)TH COLUMN
0100000100010011101001110101 0100

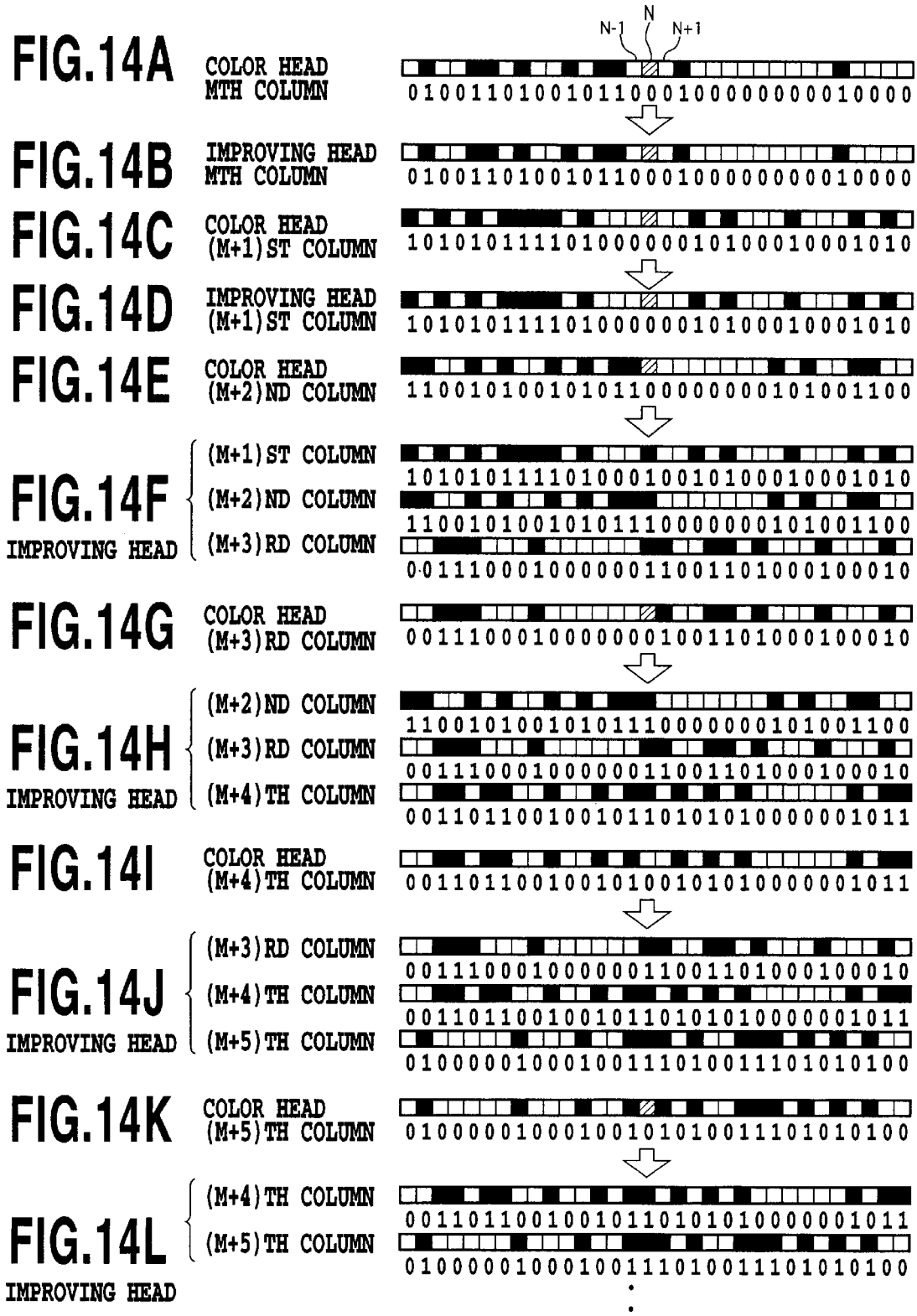
N-1
N
N+1
FIG.14A
COLOR HEAD MTH COLUMN
0100110100101100010000000000010000
FIG.14B
IMPROVING HEAD MTH COLUMN
0100110100101100010000000000010000
FIG.14C
COLOR HEAD (M+1)ST COLUMN
1010101111010000001010001000101 0
FIG.14D
IMPROVING HEAD (M+1)ST COLUMN
1010101111010000001010001000101 0
FIG.14E
COLOR HEAD (M+2)ND COLUMN
1100101001010110000000010100110 0
FIG.14F
IMPROVING HEAD
(M+1)ST COLUMN
1010101111010001001010001000101 0
(M+2)ND COLUMN
1100101001010111000000010100110 0
(M+3)RD COLUMN
0·0111000100000011001101000100010
FIG.14G
COLOR HEAD (M+3)RD COLUMN
0011100010000000100110100010001 0
FIG.14H
IMPROVING HEAD
(M+2)ND COLUMN
1100101001010111000000010100110 0
(M+3)RD COLUMN
0011100010000000110011010001000 10
(M+4)TH COLUMN
0011011001001011010101000000101 1
FIG.14I
COLOR HEAD (M+4)TH COLUMN
0011011001001011010101000000101 1
FIG.14J
IMPROVING HEAD
(M+3)RD COLUMN
0011100010000000110011010001000 10
(M+4)TH COLUMN
0011011001001011010101000000101 1
(M+5)TH COLUMN
0100000100010011101001110101010 0
FIG.14K
COLOR HEAD (M+5)TH COLUMN
0100000100010011101001110101010 0
FIG.14L
IMPROVING HEAD
(M+4)TH COLUMN
0011011001001011010101000000101 1
(M+5)TH COLUMN
0100000100010011101001110101010 0

N-1
N
N+1

COLOR HEAD
0100110100101100010000000000010000

IMPROVING HEAD
0100110100101100010000000000010000

COLOR HEAD
(M+1)ST COLUMN
1010101111010000001010001000101 0

IMPROVING HEAD
(M+1)ST COLUMN
1010101111010000001010001000101 0
N-1
N

COLOR HEAD
(M+2)ND COLUMN
1100101001010110000000001010011 00

IMPROVING HEAD
(M+2)ND COLUMN
1100101001010101000000001010011 00
N+1

COLOR HEAD
(M+3)RD COLUMN
0011100010000000100110100010001 0

IMPROVING HEAD
(M+3)RD COLUMN
0011100010000001000110100010001 0
N-1

COLOR HEAD
(M+4)TH COLUMN
0011011001001010010101000000101 1

IMPROVING HEAD
(M+4)TH COLUMN
0011011001001001010101000000101 1
N-1
N+1

COLOR HEAD
(M+5)TH COLUMN
0100000100010010101001110101010 0

IMPROVING HEAD
(M+5)TH COLUMN
0100000100010001001001110101010 0

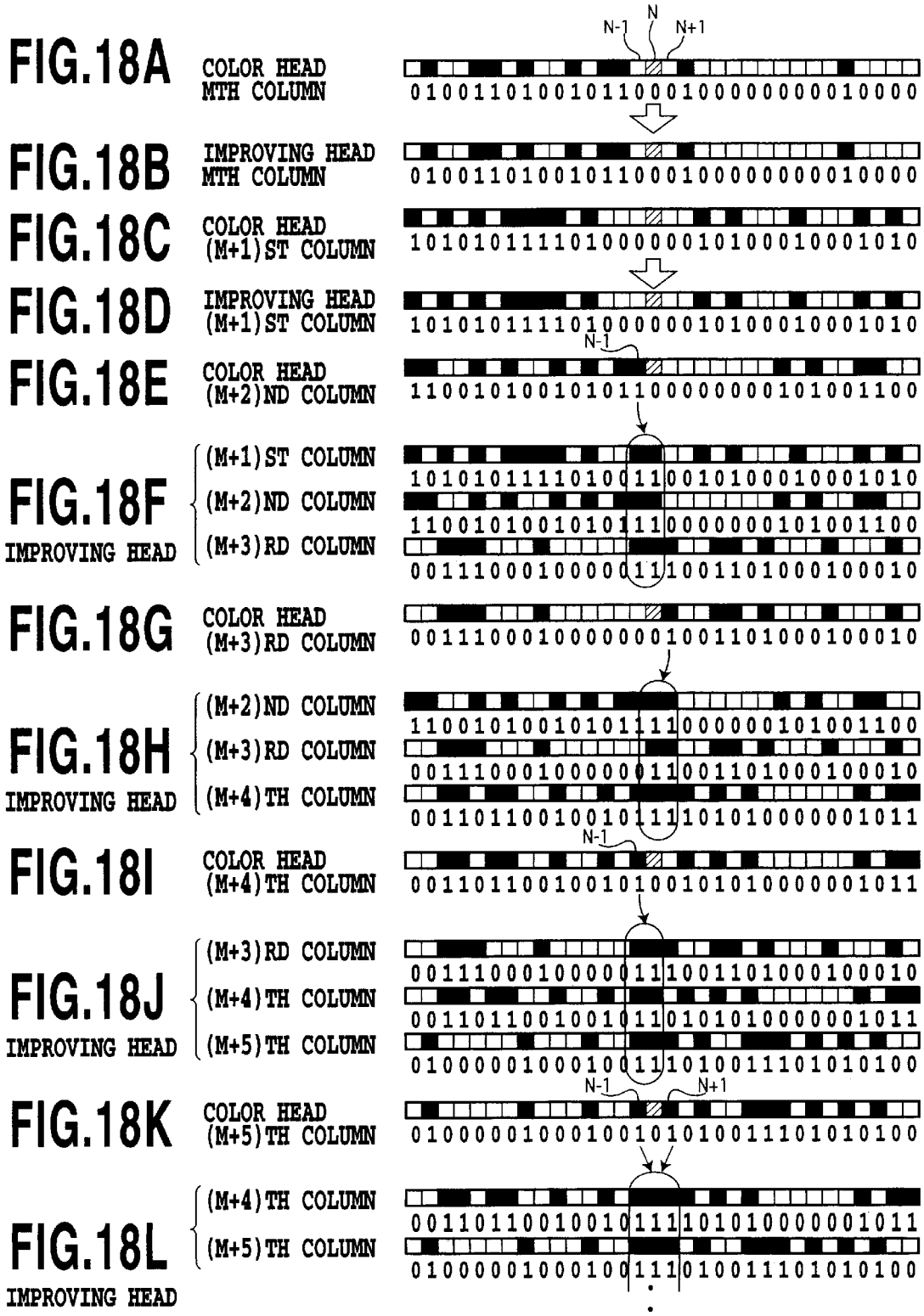
FIG.18A
COLOR HEAD MTH COLUMN
N-1
N
N+1
0100110100101100010000000000010000
FIG.18B
IMPROVING HEAD MTH COLUMN
0100110100101100010000000000010000
FIG.18C
COLOR HEAD (M+1)ST COLUMN
1010101111010000001010001000101 0
FIG.18D
IMPROVING HEAD (M+1)ST COLUMN
1010101111010000001010001000101 0
FIG.18E
COLOR HEAD (M+2)ND COLUMN
N-1
1100101001010110000000001010011 00
FIG.18F
IMPROVING HEAD
(M+1)ST COLUMN
1010101111010011001010001000101 0
(M+2)ND COLUMN
1100101001010111000000001010011 00
(M+3)RD COLUMN
0011100010000011100110100010001 0
FIG.18G
COLOR HEAD (M+3)RD COLUMN
0011100010000000100110100010001 0
FIG.18H
IMPROVING HEAD
(M+2)ND COLUMN
1100101001010111000000001010011 00
(M+3)RD COLUMN
0011100010000001100110100010001 0
(M+4)TH COLUMN
0011011001001011101010000001011
FIG.18I
COLOR HEAD (M+4)TH COLUMN
N-1
0011011001001010010101000000 1011
FIG.18J
IMPROVING HEAD
(M+3)RD COLUMN
0011100010000011100110100010001 0
(M+4)TH COLUMN
0011011001001011010101000000 1011
(M+5)TH COLUMN
0100000100010011101001110101 0100
FIG.18K
COLOR HEAD (M+5)TH COLUMN
N-1
N+1
0100000100010010101001110101 0100
FIG.18L
IMPROVING HEAD
(M+4)TH COLUMN
0011011001001011101010000001011
(M+5)TH COLUMN
0100000100010011101001110101 0100

INK JET PRINTING METHOD AND APPARATUS

This application is based on Patent Application No. 2000-266159 filed Sep. 1, 2000 in Japan, the content of which is incorporated hereinto by reference.

BACKGROUND OF THE INVENTION

1. Field of the Invention

The present invention relates to an ink jet printing method and apparatus which uses a print head having an array of ink nozzles formed therein, color inks containing colorants and a liquid for improving a print performance (hereinafter referred to as a print performance improving ink) and prints an image on a print medium. The present invention is applicable to all apparatus using print media including paper, cloth, leather, non-woven fabric, OHP sheets and even metals. Examples of applicable apparatus include office equipment such as printers, copying machines and facsimiles and industrial production equipment.

2. Description of the Related Art

As the spread of copying machines, information processing devices such as word processors and computers, and ink jet printing apparatus as output devices for these equipment to record images have come into increasingly widespread use.

In an ink jet printing apparatus described above, a print head has a plurality of ink nozzles arrayed therein and also a plurality of ink ejection ports and ink passages integrally formed therein to improve a printing speed. In recent years, two or more print heads are used to deal with color printing.

The ink jet printing system ejects droplets of ink or print liquid onto a print medium such as paper to form ink dots on the medium. Because it is of non-contact type, its noise level is low. An increased density of nozzles can enhance the resolution and printing speed, and high quality images can be produced with low cost without requiring special processing such as development and fixing even on such print mediums as plain paper. Because of these advantages, the ink jet printing apparatus is finding a widening range of applications.

An on-demand type ink jet printing apparatus in particular can easily cope with color printing and a printing apparatus body itself can be reduced in size and simplified. Therefore, the on-demand type ink jet printing apparatus is expected to capture a wide range of demands in the future. As the color printing becomes more widespread, there are increasing demands for a higher image quality and a faster printing speed.

In such an ink jet printing system, a technique has been proposed which uses a print performance improving ink capable of improving the condition of color dots on a print medium to enhance an image quality. The print performance improving ink is a colorless or light-colored liquid containing a compound that makes colorants in color inks insoluble. When mixed and/or reacted with color inks on a print medium, the print performance improving ink improves water resistance and weatherability of color dots to produce a highly reliable image quality and at the same time reduces feathering or bleeding between different colors to provide a high quality with high print density.

The conventional ink jet printing apparatus, however, has the following problems even when the print performance improving ink is used.

Where a print head with a plurality of ink nozzles arrayed therein is used, if one or more nozzles are clogged or cannot be driven for some reason, ink cannot be ejected from these nozzles, failing to print dots that need to be printed on the print medium. This results in blank lines being formed on an image extending in a main scan direction, significantly degrading the image quality.

Further, when the print head has faulty nozzles whose ejection conditions greatly differ from those of normal nozzles, a blank line or some form of line due to uneven densities is generated on an image, also degrading the image quality substantially.

Such lines become conspicuous when a multipass printing is not performed or when the number of passes during the multipass printing is small.

To deal with this problem, in the event that there are non-ejecting nozzles or faulty nozzles, it has been a common practice to use a nozzle cleaning mechanism to recover the ejection performance of the non-ejecting or faulty nozzles. When a multipass printing is performed in which one complete printed line is produced by a plurality of passes, a conventional practice has been to replace the non-ejecting or faulty nozzles with complementary nozzles.

The multipass printing system, however, has a drawback that because the paper is fed by 1/n the nozzles used and data which is complementarily culled to 1/n is printed n times during the main scan to print one raster line with a plurality (n) of nozzles, the printing time takes that much longer. The cleaning for recovering the printing performance has a drawback of taking time and causing a cost increase due to consumption of ink. Simply replacing a print head having non-ejecting or faulty nozzles is not desirable in terms of ecology.

What is required of a future ink jet printing apparatus is to realize a faster printing speed and a reduced cost while at the same time enhancing an image quality.

SUMMARY OF THE INVENTION

The present invention has been accomplished in light of the problems described above and it is an object in solving these problems to provide an ink jet printing method and apparatus which, even when there are abnormal (non-ejecting or faulty) nozzles, can print an image with simple processing that has smooth gradations without any image quality degradations including blank lines.

According to one aspect, the present invention to achieve the above objective provides an ink jet printing method, which forms an image on a print medium according to input image data by using a color ink print head and a print performance improving ink print head, the color ink print head having a plurality of ink ejection ports arrayed therein, the print performance improving ink print head having a plurality of ink ejection ports arrayed therein, and by ejecting a color ink from the color ink print head and a print performance improving ink from the print performance improving ink print head onto the print medium, the ink jet printing method comprising: a first step of identifying an abnormal ink ejection port with a degraded ink ejection state from among the plurality of ink ejection ports of the color ink print head; and a second step of, based on image data for ink ejection ports in the vicinity of the identified abnormal ink ejection port, selecting a dot to be applied the print performance improving ink on a print line corresponding to the abnormal ink ejection port, and then applying the print performance improving ink to the selected dot.

For example, the second step, based on image data for ink ejection ports in the vicinity of the abnormal ink ejection port, selects dots to be applied the print performance improving ink on a print line corresponding to the abnormal ink ejection port and on at least one print line each immediately before and after the abnormal print line, and applies the print performance improving ink to the selected dots.

According to another aspect, the present invention provides an ink jet printing apparatus, which forms an image on a print medium according to input image data by using a color ink print head and a print performance improving ink print head, the color ink print head having a plurality of ink ejection ports arrayed therein, the print performance improving ink print head having a plurality of ink ejection ports arrayed therein, and by ejecting a color ink from the color ink print head and a print performance improving ink from the print performance improving ink print head onto the print medium, the ink jet printing apparatus comprising: an identifying means for identifying an abnormal ink ejection port with a degraded ink ejection state from among the plurality of ink ejection ports of the color ink print head; and a control means for, based on image data for ink ejection ports in the vicinity of the identified abnormal ink ejection port, selecting a dot to be applied the print performance improving ink on a print line corresponding to the abnormal ink ejection port, and then applying the print performance improving ink to the selected dot.

With this invention because the print performance improving ink are applied to positions corresponding to a failed or faulty nozzle and to its vicinity according to the failed/faulty nozzle position data, the color ink dots on lines immediately before and after the non-ejecting nozzle line can be spread into the blank line in a so-called primer effect, thus making the blank line undistinguishable.

With this invention, therefore, even when there is a failed or faulty nozzle in the color ink print head, the blank lines in a printed image can be reduced substantially with simple processing, assuring a high quality of the image. Thus, the ink head with the failed nozzle can be used for a long period of time without replacing, which is desirable also in terms of ecology.

The above and other objects, effects, features and advantages of the present invention will become more apparent from the following description of embodiments thereof taken in conjunction with the accompanying drawings.

BRIEF DESCRIPTION OF THE DRAWINGS

FIGS. 12A to 12N are diagrams showing print data of a color ink and a print performance improving ink before and after the correction processing according to the second embodiment of the invention;

FIGS. 14A to 14L are diagrams showing print data of a color ink and a print performance improving ink before and after the correction processing according to the third embodiment of the invention;

FIGS. 18A to 18L are diagrams showing print data of a color ink and a print performance improving ink before and after the correction processing according to the fifth embodiment of the invention.

DETAILED DESCRIPTION OF PREFERRED EMBODIMENTS

Now, embodiments of the present invention will be described in detail by referring to the accompanying drawings.

Figure 1:
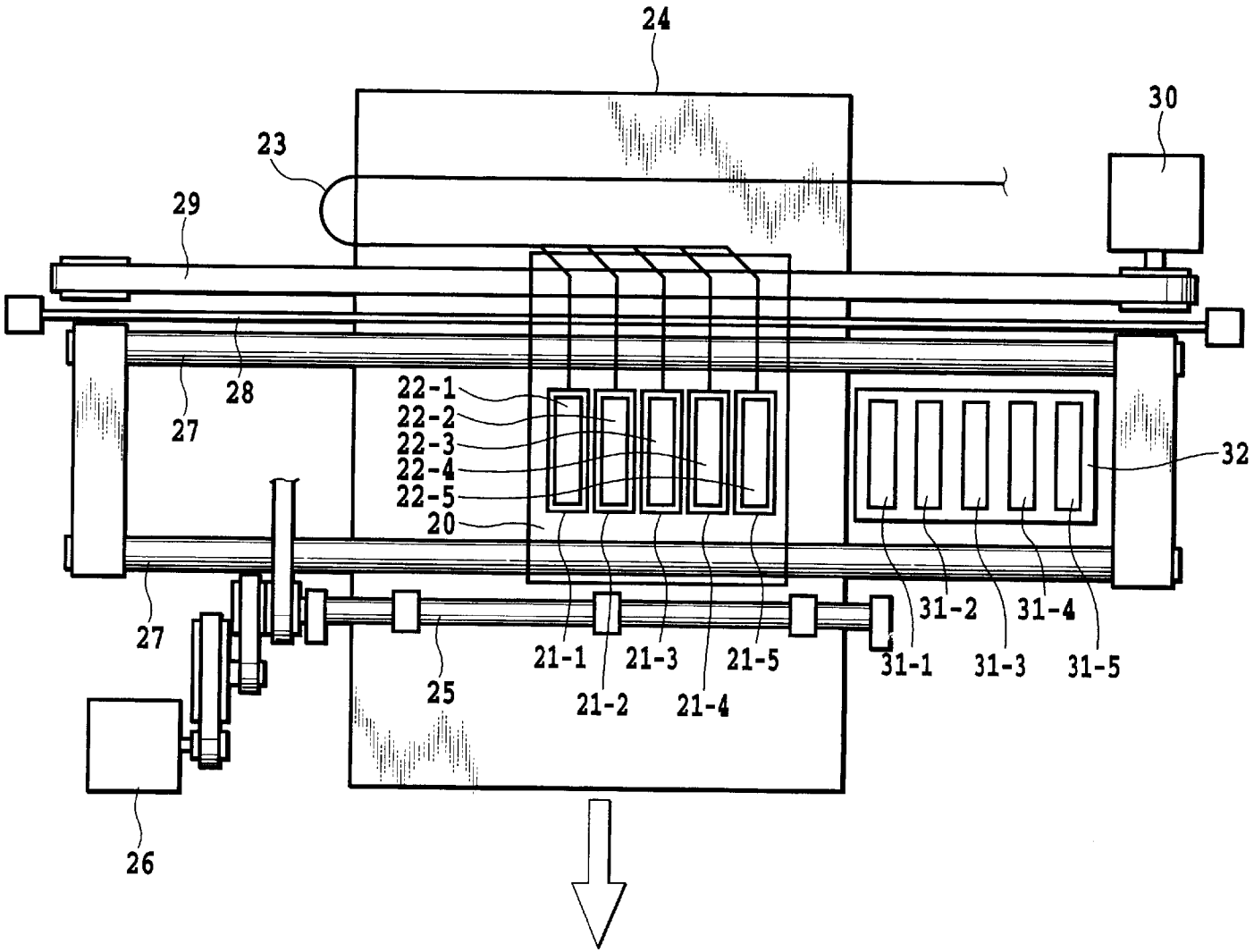
FIG. 1 is a plan view showing a schematic construction of an ink jet printing apparatus as one embodiment of the present invention.

FIG. 1 is a plan view showing a schematic construction of one embodiment of an ink jet printing apparatus according to the present invention.

In FIG. 1, a plurality of ink jet heads (print heads) 21-1 to 21-5 are mounted on a carriage 20. Each ink jet head 21, as shown in FIG. 2, has arrayed therein a plurality of ink ejection ports 108 for ejecting ink. 21-1, 21-2, 21-3, 21-4 and 21-5 represent ink jet heads for black (K), print performance improving ink (P), cyan (C), magenta (M) and yellow (Y).

Figure 2:
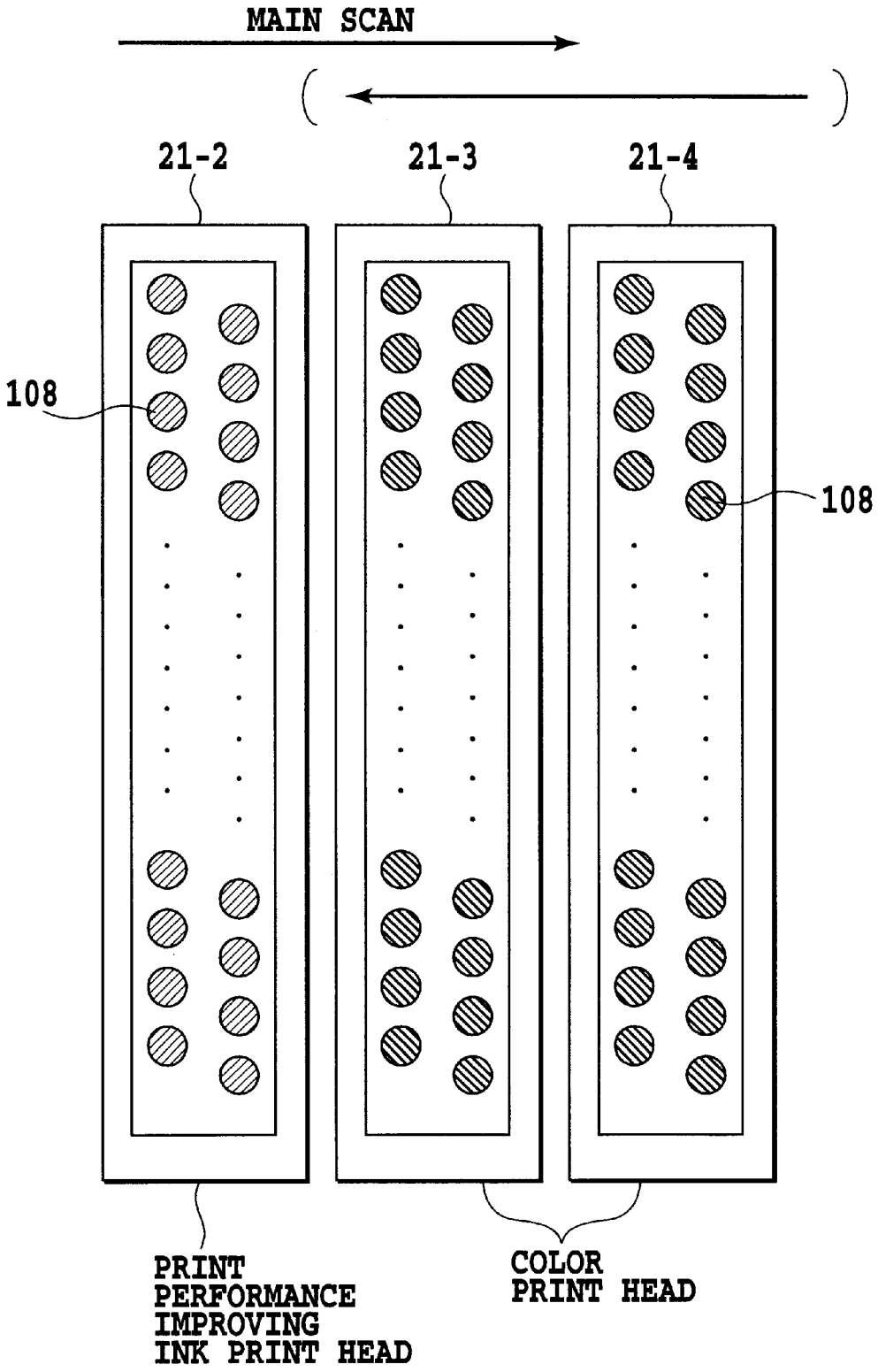
FIG. 2 is a conceptual diagram showing an arrangement of ink ejection ports in ink jet print heads.

As shown in FIG. 2, the print head 21-2 for ejecting print performance improving ink (P) has 32 ink ejection ports 108 arranged in two columns staggered from each other. That is, each of the ink ejection ports 108 in one column is located between the adjacent ink ejection ports 108 in the other column. Similar arrangement is made for the color ink print head 21-1, 1-3, . . . , with 32 ink ejection ports 108 arranged in two staggered columns. Inside the ink ejection ports (liquid paths) in each print head 21 are provided heating elements (electrothermal energy transducers) that generate thermal energy for ejecting ink.

An ink cartridge 21 comprises print heads 21-1 to 21-5 and ink tanks 22-1 to 22-5 for supplying ink to the heads.

A control signal to the ink jet heads 21 is applied through a flexible cable 23. A print medium 24, such as plain paper, high quality dedicated paper, OHP sheets, glossy paper, glossy films and post cards, are fed by feed rollers not shown and held and transported in a direction of arrow (sub-scan direction) as a transport motor 26 is driven.

The carriage 20 is supported on guide shafts 27 so that it can be moved along the guide shafts 27. The carriage 20 is reciprocated in the main scan direction along the guide shafts 27 by a carriage motor 30 through a drive belt 29. Along the guide shafts 27 is installed a linear encoder 28. At the read timing of the linear encoder 28 the heating elements of each print head 21 are driven according to the image data to eject ink droplets onto the print medium, with the ink droplets adhering to the print medium to form an image.

At a home position of the carriage 20 set outside the printing area, a recovery unit 32 having a cap portion 31 is installed. When printing is not performed, the carriage 20 is moved to the home position where caps 31-1 to 31-5 of the cap portion 31 hermetically cover a face of the ink ejection ports of each ink jet head 21 to prevent clogging of the ink ejection ports which may otherwise be caused by an evaporation of ink solvent and a resulting increase in viscosity or by adhering foreign matters such as dust.

The capping function of the capping portion 31 is used to perform a recovering ejection by which ink is ejected from the ink ejection ports into the cap portion to eliminate improper ejection or clogging of those ink ejection ports that are used only infrequently, or to perform a recovering evacuation by which a pump not shown is operated with the ejection ports capped to evacuate ink from the ink ejection ports by suction to recover the failed ejection ports to normal condition.

When each of the ink jet heads 21-1 to 21-5 passes over an ink receiving portion (not shown) just before the start of printing, the ink jet head performs a preliminary ink ejection toward the ink receiving portion. A wiping member (not shown) such as a blade is installed at a position adjacent to the cap portion 31 so that it can wipe clean the face of the ink ejection ports of each ink jet head 21.

Figure 3:
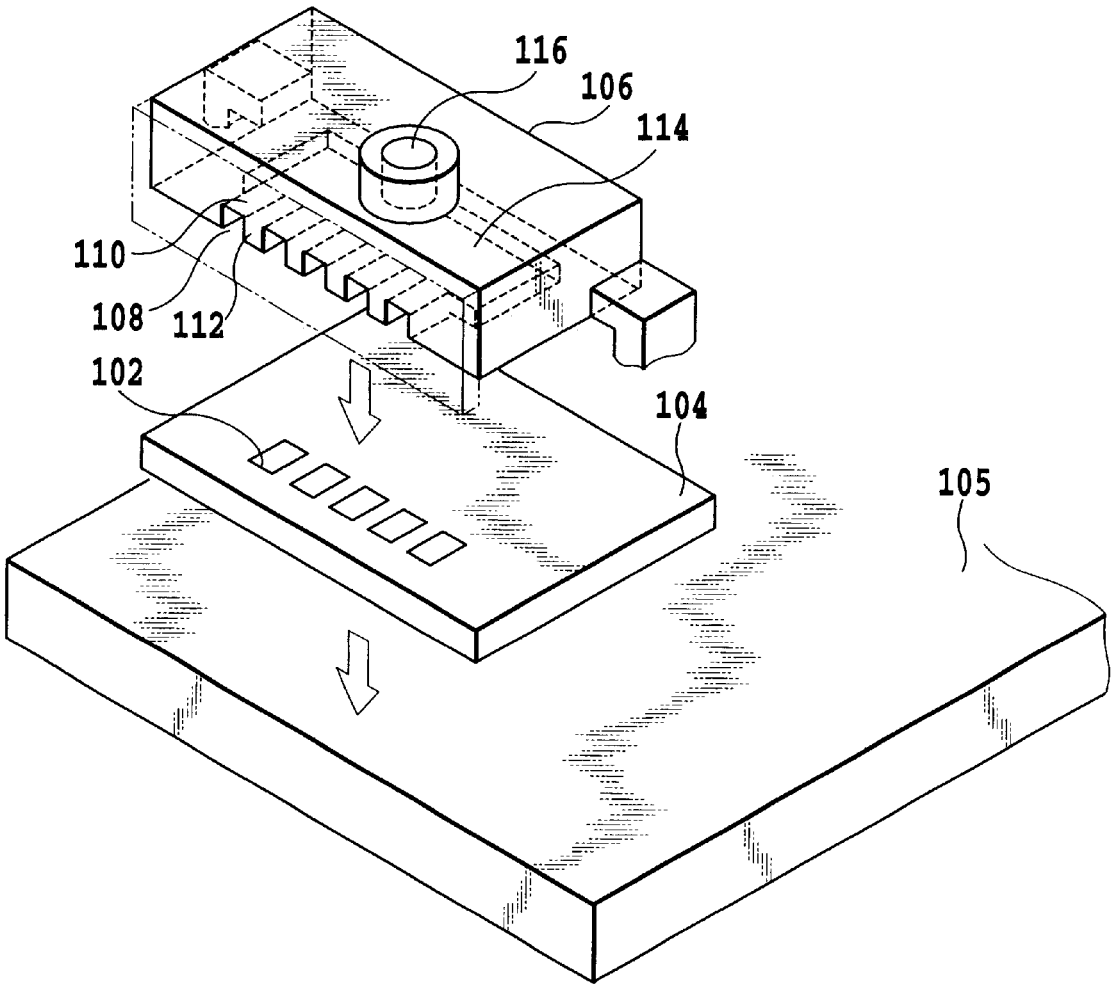
FIG. 3 is an exploded perspective view showing the construction of an ink jet print head.

FIG. 3 shows the construction of the print head 21.

In FIG. 3, the print head 21 roughly comprises a heater board 104 formed with a plurality of heaters 102 to heat ink, a top plate 106 placed on the heater board 104, and a base plate 105 supporting the heater board 104.

The top plate 106 is formed with a plurality of ink ejection ports 108, behind each of which is formed a tunnel-like liquid path 110 communicating with the corresponding ink ejection port 108. Each liquid path 110 is isolated from the adjacent liquid path by a separation wall 112. The liquid paths 110 are commonly connected at their rear end to one ink chamber 114, which is supplied with ink through an ink supply port 116. Ink is supplied from the ink chamber 114 to the individual liquid paths 110. The heater board 104 and the top plate 106 are aligned and assembled so that the heaters 102 match the corresponding liquid paths 110.

When a predetermined drive pulse is applied to the heater 102, the ink over the heater 102 boils to form a bubble, whose volume expansion pushes out an ink droplet from the ink ejection port 108.

The ink jet printing system applicable to this invention is not limited to the bubble jet (BJ) system using a heating element (heater) shown in FIG. 3. In a continuous type ink jet printing apparatus which continuously ejects ink droplets and atomizes them, this invention can also be applied to a charge control type and a dispersion control type. Further, in the on-demand type ink jet printing apparatus that ejects ink droplets as required, this invention can also be applied to a pressure control type which ejects ink droplets from orifices by mechanical vibrations of piezoelectric elements.

Figure 4:
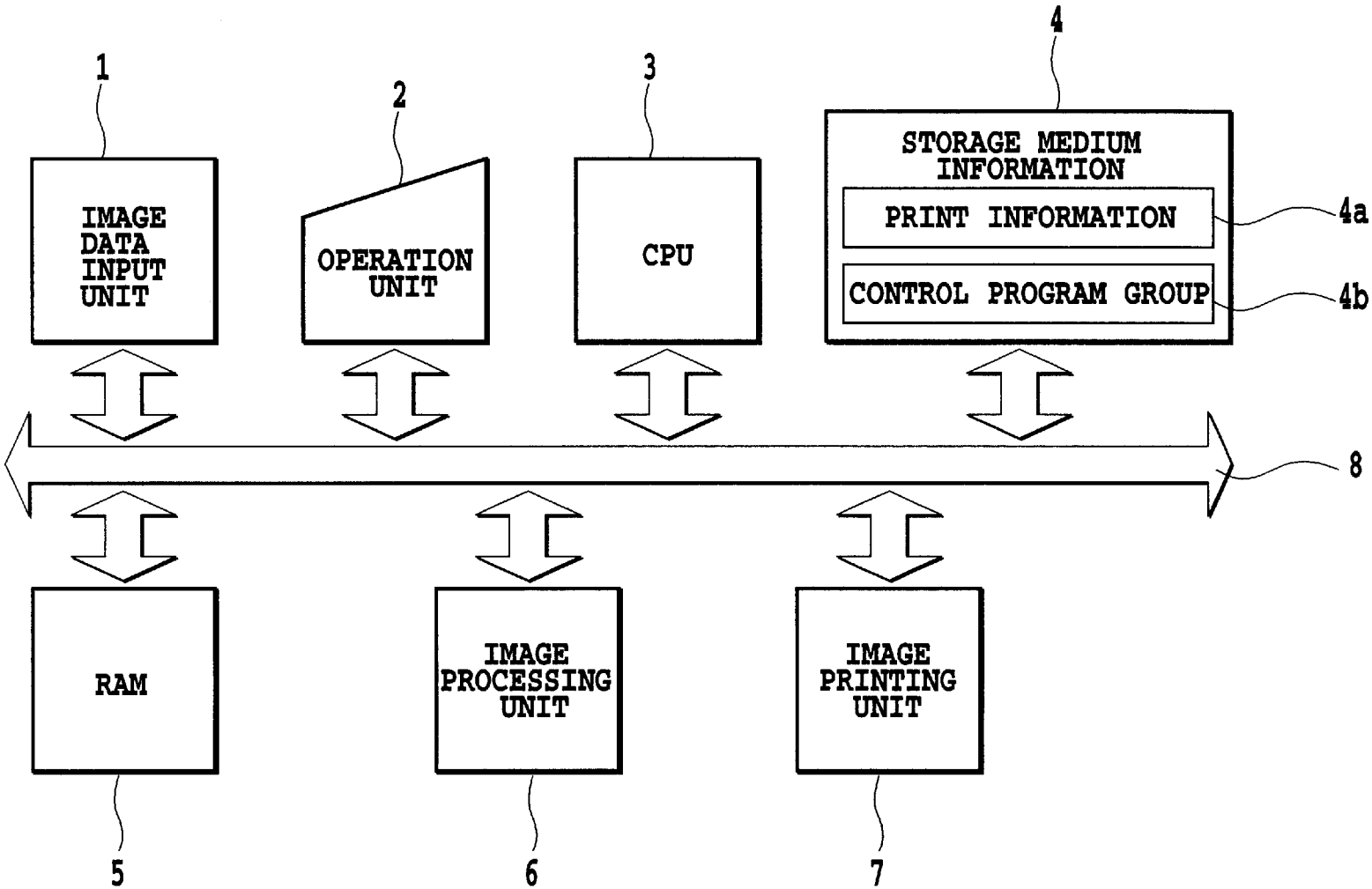
FIG. 4 is a block diagram showing an example configuration of a control system in the ink jet printing apparatus.

FIG. 4 is a block diagram showing an example configuration of a control system of the ink jet printing apparatus.

In FIG. 4, reference number 1 represents an image data input unit, 2 an operation unit, 3 a CPU for executing various processing, 4 a storage medium for storing a variety of data, 4*a* a print data storage memory for storing non-ejecting and faulty nozzle data and print data of a print performance improving ink print head, 4*b* a control program storage memory for storing a group of control programs, 5 a RAM, 6 an image processing unit, 7 an image printing unit (printer) for outputting an image, and 8 a bus having a bus line for transmitting address signals, data, control signals and others.

Entered into the image data input unit 1 are multivalued image data from image input devices such as scanner and digital camera and multivalued image data stored in hard disks of personal computers. The operation unit 2 has a variety of keys to set a variety of parameters and specify the start of printing. The CPU 3 controls the printing apparatus as a whole according to a variety of programs in the storage medium.

The storage medium 4 stores programs, such as control program and error processing program, according to which the printing apparatus is operated. The operations of this embodiment are all based on these programs. The storage medium 4 storing the programs may be a ROM, FD, CD-ROM, HD, memory card and magnetooptical disk.

A RAM 5 is used as a work area by various programs stored in the storage medium 4, as a temporary save area during the error processing, and as a work area during the image processing. The RAM 5 is also used for copying various tables from the storage medium 4, modifying the content of the tables and referencing the modified tables during the image processing.

The image data processing unit 6 separates the input multivalued image data into component colors of the associated color print heads and transforms the color-separated gray image into binary values by using an gray scale processing method such as an error spreading method and a dither matrix method.

The image printing unit 7 ejects ink according to an ejection pattern generated by the image data processing unit 6 to form a dot image on the print medium.

Next, a process of forming printed dots will be explained by referring to FIGS. 5A to 5C.

In this ink jet printing apparatus, pixels are formed by two kinds of dots, those from a color ink containing a colorant and those from the print performance improving ink.

In the following description, it is assumed that the print performance improving ink contains a cationic substance of low molecular component and high molecular component and that the color ink contains an anionic dye or at least an anionic compound and pigment. When the print performance improving ink and the color ink mix together on the print medium or in the print medium after penetrating into it, a low molecular component or cationic oligomer of the cationic substance contained in the print performance improving ink and a water-soluble dye having anionic group or an anionic pigment ink used in the color ink combine together through ionic interaction and instantly isolate from a solution phase. As a result, the pigment ink undergoes dispersive destruction to form coagulated pigments.

Figure 5A:
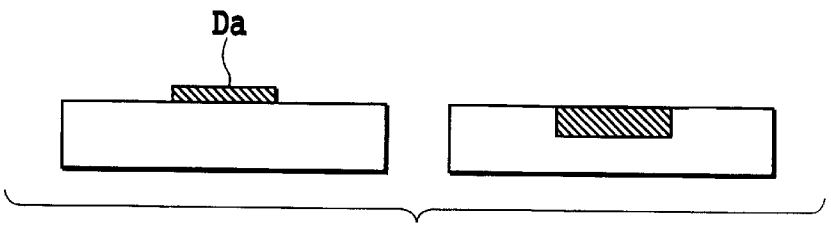
FIGS. 5A, 5B and 5C are schematic views showing states of a color ink and a print performance improving ink on a print medium.

As shown in FIG. 5A, when only a color ink droplet Da lands on the print medium 24, the ink droplet spreads horizontally in a surface layer of the print medium and seeps vertically into the medium to form an ink dot.

Figure 5B:
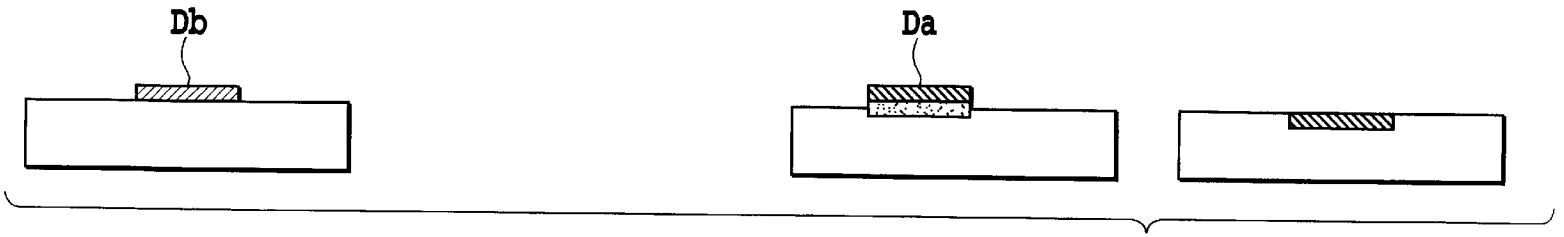

On the other hand, when the print performance improving ink droplet Db is landed on the print medium before or after or simultaneously with the color dot Da, as shown in FIG. 5B, the color ink droplet adheres to the surface layer of the print medium 24 at a shallower depth than when only the color ink is used, in the form of a coagulated colorant, thus forming a clearly defined ink dot.

Figure 5C:
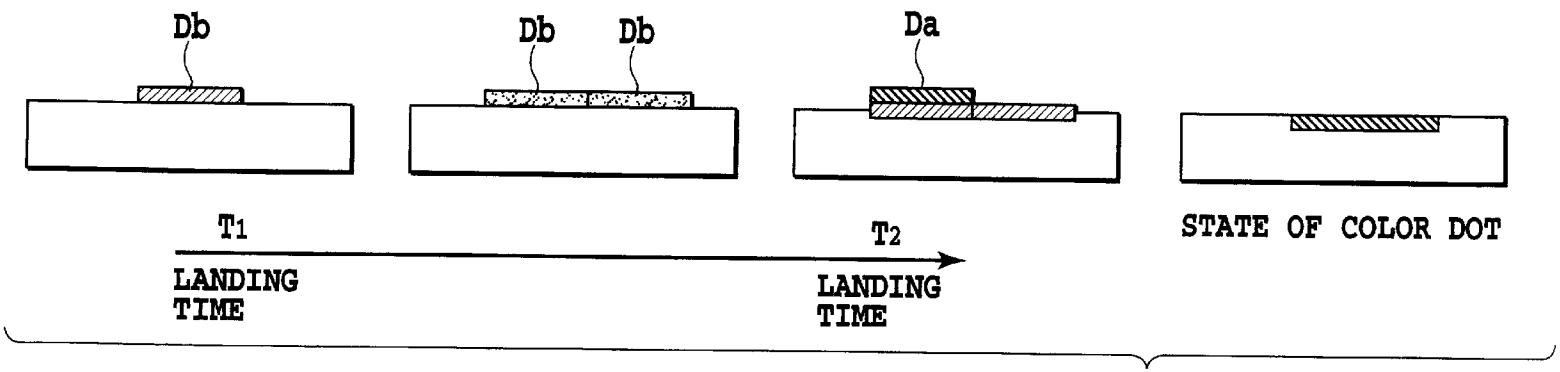

FIG. 5C shows another method of ink ejection, in which the print performance improving ink Db is first landed at an intended position corresponding to the color ink dot Da and also at its nearby position, followed by the color ink Da while the print performance improving ink is being soaked into the surface layer of the print medium. In this case, the preceding print performance improving ink Db works as primer to form a thinly spread coagulated colorant near the surface layer of the print medium. The present invention takes advantage of the phenomenon of FIG. 5C to eliminate blank lines.

An on-the-print-medium landing time difference T2-T1 between the color ink Da and the print performance improving ink Db should preferably be 2000 msec or less.

Next, the feature of this invention will be explained by referring to the flow chart of FIG. 6.

First, non-ejecting nozzles and faulty nozzles (these nozzles are referred to as abnormal nozzles or abnormal ink ejection ports) in a plurality of color ink print heads 21-1, 21-3, 21-4, 21-5 are detected. Here, the non-ejecting nozzles denote those nozzles which are clogged with highly viscous ink or solidified ink after evaporation or whose ink ejection elements are damaged and fail to eject ink. The faulty nozzles denote those nozzles whose ejection performance is significantly degraded from the normal nozzles due to some anomalies. The ejection performance degradations include those in which ink is not ejected in a normal direction and in which the amount of an ink droplet significantly differs from the intended amount.

Figure 6:
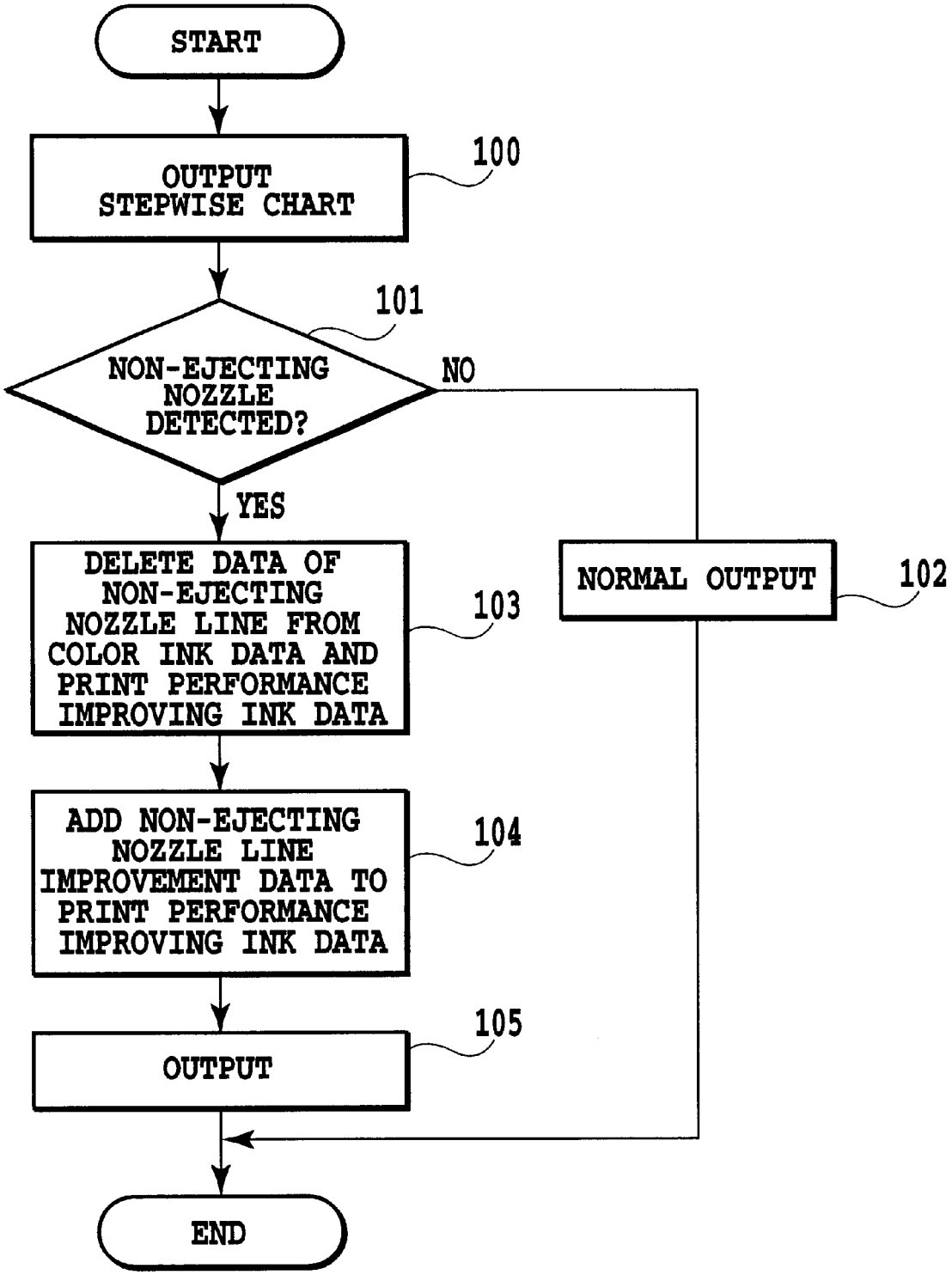
FIG. 6 is a flow chart showing a sequence of operations performed by the ink jet printing method according to this invention.
Figure 7A:
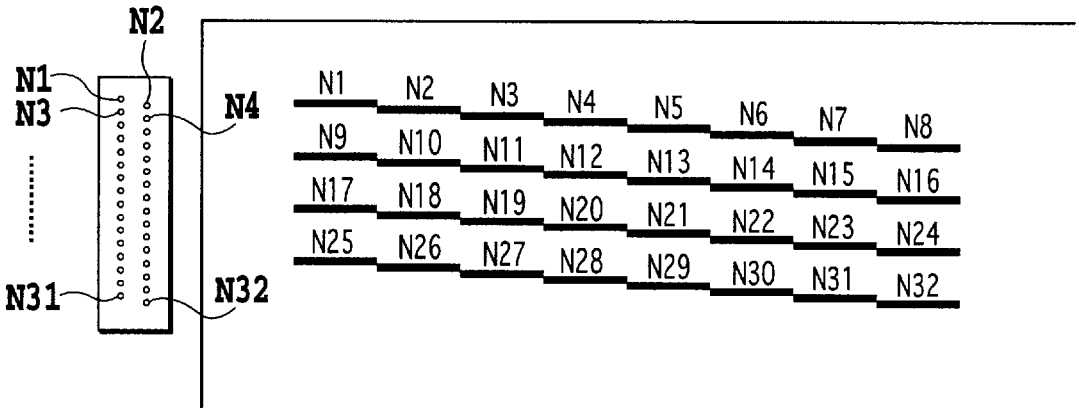
FIGS. 7A and 7B are diagrams showing an example stepped chart used to detect non-ejecting or faulty nozzles.
Figure 7B:
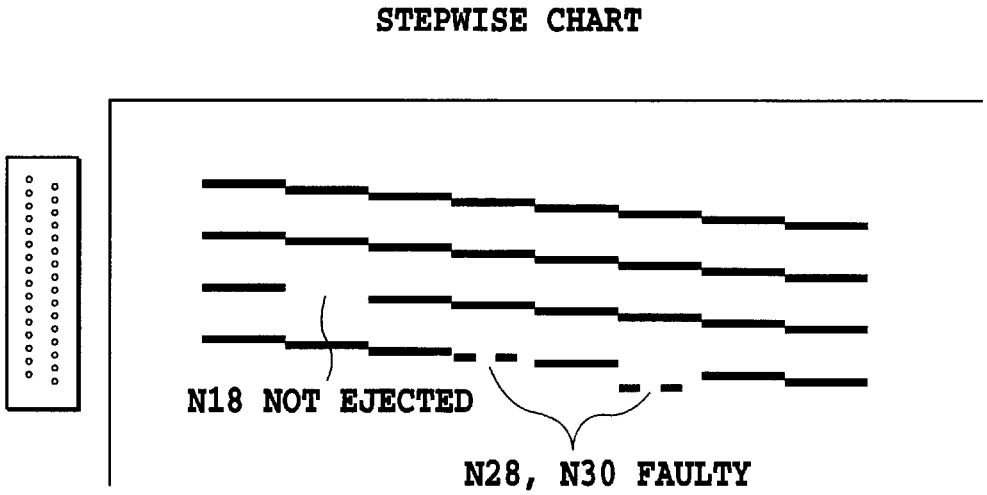

To detect abnormal nozzles, the print heads 21-1, 21-3, 21-4, 21-5 for color inks are driven to print a stepwise print pattern on the print medium 24 as shown in FIGS. 7A and 7B (step 100 of FIG. 6).

The stepwise pattern of FIGS. 7A and 7B are formed by ejecting a color ink continuously or non-continuously for eight nozzles each in a row to print stepwise short lines. When there are no abnormal nozzles, the stepwise patterns can be printed completely as shown in FIG. 7A. FIG. 7B is a stepwise pattern indicating that a non-ejecting trouble occurs with a 18th nozzle N18 and an improper or faulty ejection occurs with a 28th nozzle N28 and a 30th nozzle N30. The lines of dots printed by the non-ejecting or faulty nozzles are lost partly or entirely and they can be distinguished easily.

The printed stepwise chart is scanned by a scanning sensor, not shown, mounted on the printing apparatus and the data thus read in is subjected to recognition processing to determine which nozzle is abnormal (step 101 of FIG. 6). Alternatively, the printed chart may be visually checked without using the scanning sensor to generate non-ejecting/faulty nozzle data which is then input to the printing apparatus.

Based on the non-ejecting/faulty nozzle data for each color print head detected in this way, abnormal nozzle data is generated. The abnormal nozzle data is used to identify the non-ejecting/faulty nozzles from a plurality of nozzles. The generated abnormal nozzle data is stored in memory in the apparatus for each color print head. In the case of FIG. 7B, the abnormal nozzle data identifies nozzles N18, N28, N30 as abnormal nozzles.

When no abnormal nozzles are detected as a result of the abnormal nozzle detection process (step 101), the normal print output control is executed (step 102 of FIG. 6).

When abnormal nozzles are detected as a result of the abnormal nozzle detection process, the scan line data corresponding to the abnormal nozzle is eliminated from the nozzle drive data for the color print head and from the nozzle drive data for the print performance improving ink head according to the generated abnormal nozzle data. That is, the associated scan line data is set as non-ejection data ("0") (step 103). This may be achieved either by turning off the associated print data or electrically masking a signal to the abnormal nozzle.

Next, based on the abnormal nozzle data of the color print head, ejection failure improvement data is added in order to correct the scan line data in the print performance improving ink head nozzle drive data which corresponds to the abnormal nozzle and the scan line data for the lines adjoining the abnormal nozzle scan line (step 104). More specifically, based on the nozzle drive data for the lines immediately before and after the scan line corresponding to the abnormal nozzle in the color print head, those nozzle drive data for the print performance improving ink head that correspond to the abnormal nozzle scan line and adjoining scan lines immediately before and after the abnormal nozzle scan line are corrected.

By driving the print heads according to the nozzle drive data thus modified, an image is formed on the print medium 24 (step 105).

Now, the processing of steps 103 and 104 will be explained in more concrete terms.

In this specification, a dot position denotes a position where a dot is to be printed irrespective of whether or not a dot is actually printed.

(First Embodiment)

In the following embodiment, nozzle drive data for the print performance improving ink is generated based on the nozzle drive data for a black ink head. The amount of each print performance improving ink droplet can be increased or decreased according to the printing condition of the black head, for example increasing the amount of print performance improving ink droplet when the black head has too large a deviation in the ink ejection direction, in order to ensure that the dots printed by the black head and the dots of the print performance improving ink are closer together, thus bringing the print performance improving ink into contact with the black ink reliably.

In the first embodiment, it is assumed that the dots printed by the black head agrees in position with the dots of the print performance improving ink.

Figure 8A:
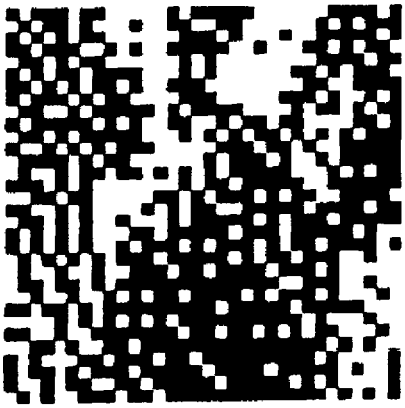
FIGS. 8A and 8B are conceptual diagrams showing print data of a color ink and a print performance improving ink when there are no non-ejecting nozzles.
Figure 8B:
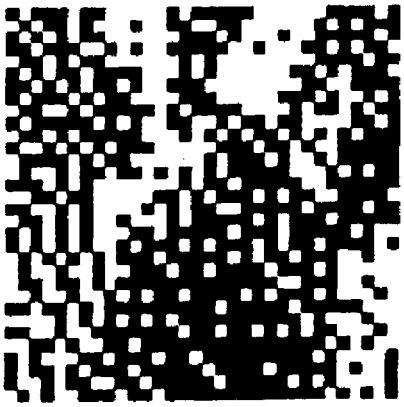

FIG. 8A represents a printed image corresponding to the black ink print data when there is no abnormal nozzle. FIG.

8B represents print data of print performance improving ink associated with the black ink print data. In this case, because there is no abnormal nozzle, both of these print data agree.

Figure 9B:
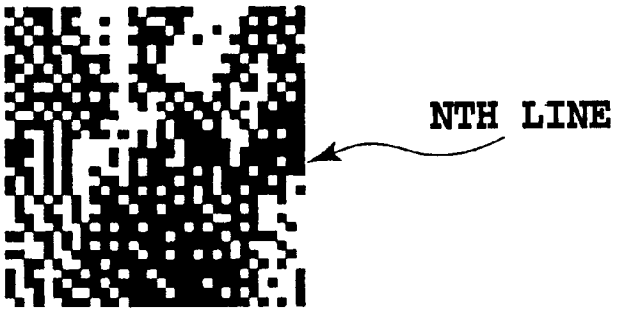
FIGS. 9A and 9B are conceptual diagrams showing print data of a color ink and a print performance improving ink before and after correction processing when there are non-ejecting nozzles.
Figure 9A:
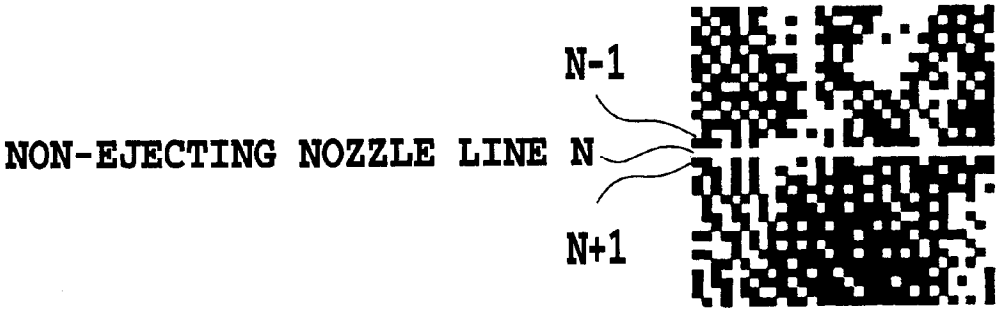

FIG. 9A shows black ink print data when there is a non-ejecting nozzle and a blank line representing the non-ejecting nozzle is seen. FIG. 9B is a print data of the print performance improving ink after correction. In this embodiment, the print data for the print performance improving ink is corrected according to the black head abnormal nozzle data. More specifically, when an Nth nozzle in the black print head is detected as a non-ejecting nozzle, print data for the Nth nozzle in the print performance improving ink head is generated as follows. First, print data for nozzles immediately before and after the Nth nozzle in the black head ((N−1)st and (N+1)st nozzles) are referenced. Only if "ejection-ON" print data exists for both of the (N−1)st line and (N+1)st line, the print data for the Nth nozzle in the print performance improving ink head will be set as "ejection-ON". In this case, if the print data for the Nth nozzle in the print performance improving ink head is ejection-ON before the correction processing but the ejection-ON print data does not exist for both the (N−1)st line and (N+1)st line in the black head, the print data for the Nth nozzle in the print performance improving ink head is changed to ejection-OFF.

Figure 10A:
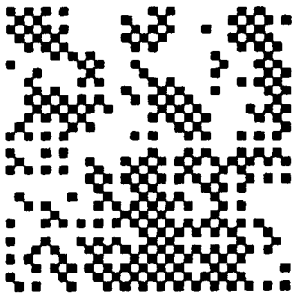
FIGS. 10A, 10B, 10C and 10D are conceptual diagrams showing print data of a color ink and a print performance improving ink after the correction processing when there are non-ejecting nozzles during a multipass printing.
Figure 10B:
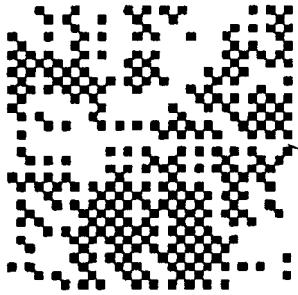
Figure 10C:
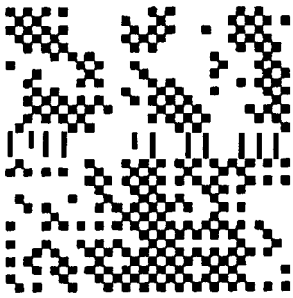
Figure 10D:
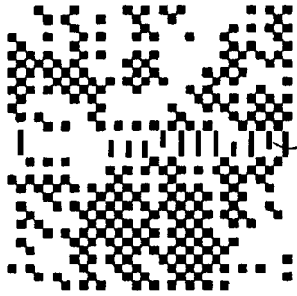

FIG. 10A shows print data of a black head for a first pass in two-pass printing when there is a non-ejecting nozzle. FIG. 10B shows print data of the black head for a second pass in which a non-ejection nozzle line is formed. FIG. 10C shows print data of print performance improving ink for a first pass after a necessary correction is made. Based on the first pass print data of the black head for the lines immediately before and after the non-ejecting nozzle line, first pass print data of print performance improving ink for a line corresponding to the non-ejection nozzle line is formed and added. FIG. 10D shows print data of print performance improving ink for a second pass after the correction process. Based on the second pass print data of the black head for the lines immediately before and after the non-ejecting nozzle line, second pass print data of the print performance improving ink for a line corresponding to the non-ejecting nozzle line is formed and added.

That is, in the two-pass printing, although a blank line in an image produced by a non-ejecting nozzle in the first pass may be printed in the second pass by other nozzles complementing that blank line, it is difficult to eliminate that blank line in the image if a nozzle passing over that blank line in the second pass is also a non-ejecting nozzle. Therefore in a multipass printing, too, the processing shown in FIGS. 10A to 10D are carried out to deliberately apply the print performance improving ink as primer to selected dots on the non-ejecting nozzle line and thereby induce the color ink dots on the lines adjoining the non-ejecting nozzle line to spread into the blank line, thus making the blank line undistinguishable.

In the multipass printing, the above-described primer effect decreases as the landing time difference increases between the color dot and the print performance improving ink dot intended to contact the color dot to spread it. Hence, it is necessary to eject the color dot and the associated print performance improving ink dot in the same pass.

(Second Embodiment)

Next, a second embodiment of this invention will be described by referring to FIG. 11 and FIGS. 12A to 12N.

In the second embodiment, a print head 21 is used which ejects ink droplets each measuring 8.5±0.5 pl at a resolution of 600 dpi.

The compositions of the color inks containing colorants and the composition of the print performance improving ink are as follows.

| | |
|---|---|
| Yellow Ink | |
| Glycerine | 5.0 wt % |
| Thiodiglycol | 5.0 wt % |
| Urea | 5.0 wt % |
| Isopropyl alcohol | 4.0 wt % |
| Acetylenol EH (KawaKen Fine Chemical) | 1.0 wt % |
| Dystuff, C.I. Direct Yellow 142 | 2.0 wt % |
| Water | 78.0 wt % |
| (Magenta Ink) | |
| Glycerine | 5.0 wt % |
| Thiodiglycol | 5.0 wt % |
| Urea | 5.0 wt % |
| Isopropyl alcohol | 4.0 wt % |
| Acetylenol EH (KawaKen Fine Chemical) | 1.0 wt % |
| Dystuff, C.I. Acid Red 289 | 2.5 wt % |
| Water | 77.5 wt % |
| (Cyan Ink) | |
| Glycerine | 5.0 wt % |
| Thiodiglycol | 5.0 wt % |
| Urea | 5.0 wt % |
| Isopropyl alcohol | 4.0 wt % |
| Acetylenol EH (KawaKen Fine Chemical) | 1.0 wt % |
| Dystuff, C.I. Direct Blue 199 | 2.5 wt % |
| Water | 77.5 wt % |
| (Black Ink) | |
| Glycerine | 5.0 wt % |
| Thiodiglycol | 5.0 wt % |
| Urea | 5.0 wt % |
| Isopropyl alcohol | 4.0 wt % |
| Dystuff, Food Black 2 | 3.0 wt % |
| Water | 78.0 wt % |
| (Print Performance Improving Ink) | |
| Polyarylamine hydrochloride | 5.0 wt % |
| Benzalkonium chloride | 1.0 wt % |
| Diethylene glycol | 10.0 wt % |
| Acetylenol EH (KawaKen Fine Chemical) | 1.0 wt % |
| Water | 83.0 wt % |

The print medium used was PB-Paper (Canon) for electrophotographic and ink jet printing.

Figure 11:
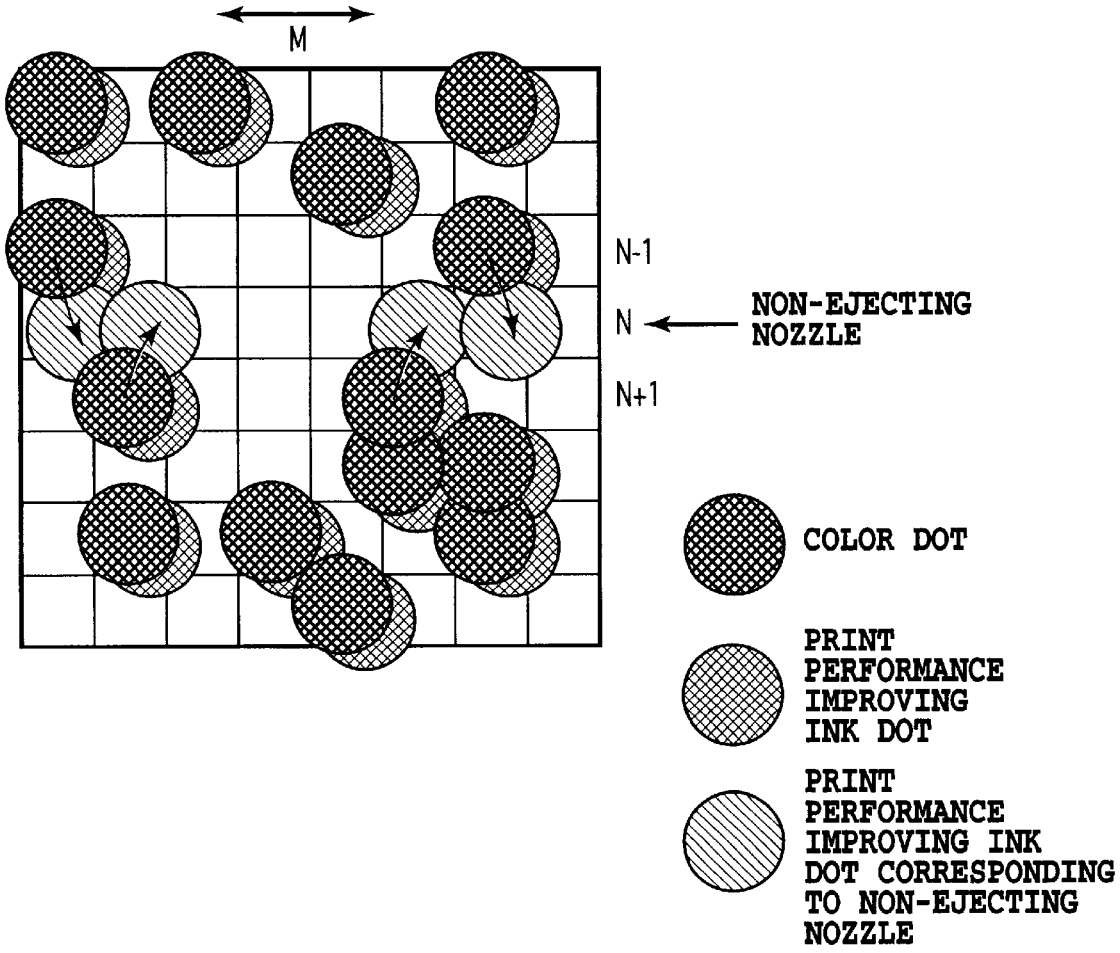
FIG. 11 is a diagram showing dot arrangements of a color ink and a print performance improving ink after the correction processing according to a second embodiment of the invention.

In the second embodiment, a dot matrix of the print performance improving ink is printed shifted 1/k pixel (e.g., ¼ pixel or ½ pixel) from that of the corresponding color ink, as shown in FIG. 11. In the case of FIG. 11, the dots of the print performance improving ink are printed deviated to the lower right in the figure by ¼ pixel from the corresponding dots of the color ink. This can be realized easily as by shifting the color print head and the print performance improving ink print head from each other by a predetermined distance when fixing them to the carriage.

With the dot positions of the print performance improving ink shifted from the corresponding dot positions of the color ink as described above, it is possible to allow the color dots to spread or broaden out to the dot positions of the non-ejecting nozzles.

The processing of steps 103 and 104 of FIG. 6 in the second embodiment will be described in more concrete terms by referring to FIGS. 12A to 12N.

FIG. 12A schematically shows digitized image data, before being corrected, which is to be printed by a print performance improving ink print head having 32 nozzles (ink ejection ports) and which spans six columns of 32 dots (pixels) each (Mth to (M+5)th columns) in the main scan direction. A black solid pixel represents a dot of image data "1" and a blank pixel represents a dot of image data "0".

FIG. 12B schematically shows digitized image data to be printed by a color print head having 32 nozzles and which spans six columns of 32 dots each (Mth to (M+5)th columns) in the main scan direction. In this case, it is assumed that the color print head and the print performance improving ink print head are given the same image data (nozzle drive data).

Suppose that an Nth nozzle in the color print head (in this case N=16) is a non-ejecting nozzle, as shown in FIG. 12B.

Because the Nth nozzle in the color print head (N=16) is a non-ejecting nozzle, the image data to be given to the color print head which ranges from Mth column to (M+5)th column are corrected to set Nth nozzle print data to "0" (no ejection) regardless of whether the original image data at the corresponding pixels are "0" or "1", as shown in FIGS. 12C, 12E, 12G, 12I, 12K and 12M.

As for the image data to be given to the print performance improving ink print head which ranges from Mth column to (M+5)th column, a check is made on print data "0" or "1" for (N−1)st and (N+1)st nozzles on the same columns of the color print head. Based on the print data for these (N−1)st and (N+1)st nozzles, the image data for the print performance improving ink head is set to "0" (no ejection) or "1" (ejection). In this embodiment, if "1" exists in any of the print data for (N−1)st and (N+1)st nozzles of the color print head, the print data for the Nth nozzle of the print performance improving ink head is set to "1".

That is, as shown in FIG. 12C, there are no image data for (N−1)st and (N+1)st nozzles on the Mth column of the color print head. Hence, as shown in FIG. 12D, the print data for Nth nozzle on the Mth column of the print performance improving ink head is set to "0".

Next, as shown in FIG. 12E, there are no image data for (N−1)st and (N+1)st nozzles on the (M+1)st column of the color print head. Hence, as shown in FIG. 12F, the print data for Nth nozzle on the (M+1)st column of the print performance improving ink head is set to "0".

Next, as shown in FIG. 12G, there is image data for (N−1)st nozzle on the (M+2)nd column of the color print head. Hence, as shown in FIG. 12H, the print data for Nth nozzle on the (M+2)nd column of the print performance improving ink head is corrected to "1".

Next, as shown in FIG. 12I, there is image data for (N+1)st nozzle on the (M+3)rd column of the color print head. Hence, as shown in FIG. 12J, the print data for Nth nozzle on the (M+3)rd column of the print performance improving ink head is corrected to "1".

Next, as shown in FIG. 12K, there is image data for (N−1)st nozzle on the (M+4)th column of the color print head. Hence, as shown in FIG. 12L, the print data for Nth nozzle on the (M+4)th column of the print performance improving ink head is corrected to "1".

Next, as shown in FIG. 12M, there are image data for (N−1)st and (N+1)st nozzles on the (M+5)th column of the color print head. Hence, as shown in FIG. 12N, the print data for Nth nozzle on the (M+5)th column of the print performance improving ink head is corrected to "1".

In this way, the similar processing continues to be carried out for the entire image data by printing dots with the color ink and the print performance improving ink.

FIG. 11 shows printed dots according to the color dot print data and the print performance improving ink print data after being corrected in the second embodiment when an Nth nozzle in the color print head fails to eject ink.

As can be seen from this figure, print performance improving ink dots are selectively added to the Nth line where the nozzle fails to eject the color ink, according to the print data for the (N−1)st and (N+1)st nozzles of the color head.

(Third Embodiment)

Next, a third embodiment of this invention will be described by referring to FIG. 13 and FIGS. 14A to 14L.

The third embodiment is similar to the second embodiment in that the print performance improving ink print data for the Nth nozzle line where an ejection failure has occurred is generated according to the print data for (N−1)st and (N+1)st nozzle lines in the color head. What is different in the third embodiment is that print performance improving ink print data for the Nth nozzle line in (M−1)st, Mth and (M+1)st columns are generated according to the print data for (N−1)st and (N+1)st nozzle lines in the Mth column of the color head. That is, when print data "1" exists in the (N−1)st line on the Mth column or the (N+1)st line on the Mth column of the color print head, the print performance improving ink print data in the Nth nozzle line on the (M−1)st, Mth and (M+1)st columns are set to "1".

In this embodiment, a print head 21 is used which ejects ink droplets each measuring 8.5±0.5 pl at a resolution of 600 dpi, as in the second embodiment. The compositions of a color ink containing colorant and of a print performance improving ink and a print medium are similar to those of the second embodiment.

Figure 13:
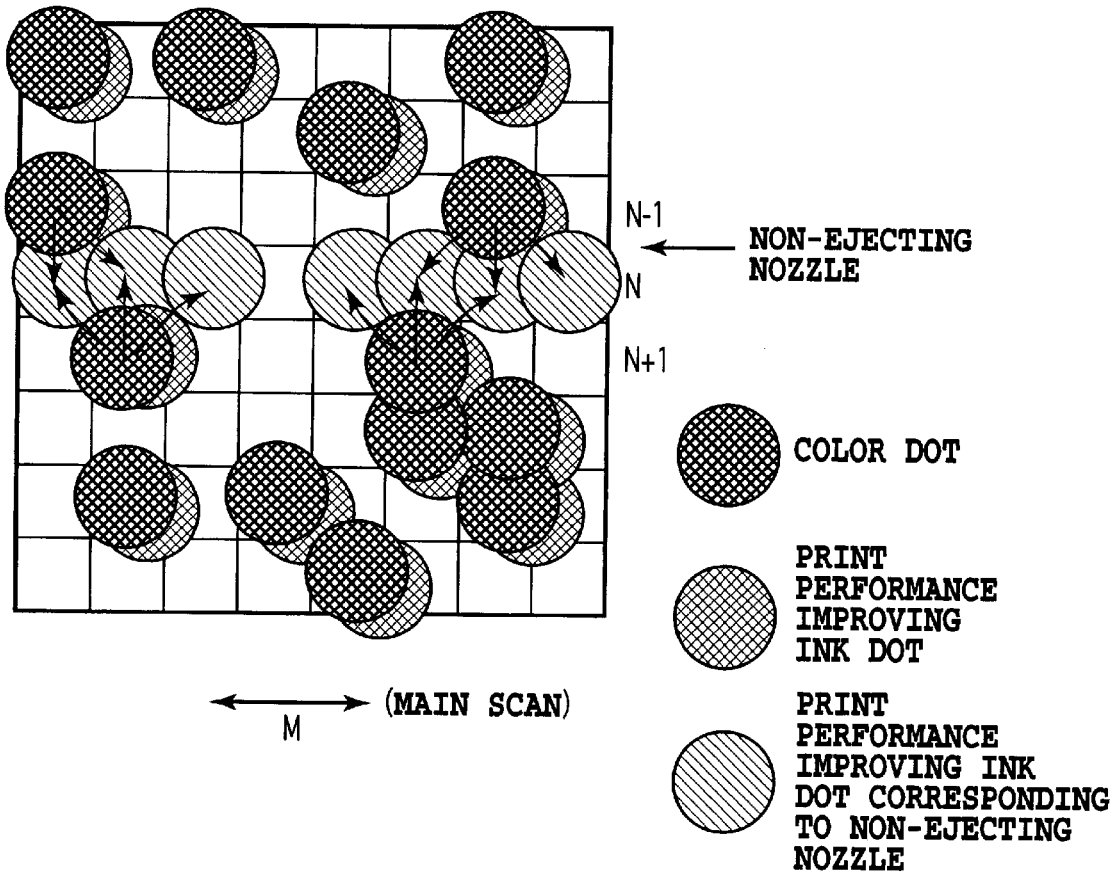
FIG. 13 is a diagram showing dot arrangements of a color ink and a print performance improving ink after the correction processing according to a third embodiment of the invention.

As shown in FIG. 13, the print performance improving ink dots are printed deviated to the lower right by ¼ pixel from the corresponding color ink (black ink) dots, as in the second embodiment.

Because the Nth nozzle in the color print head (N=16) is a non-ejecting nozzle, the image data to be given to the color print head which ranges from Mth column to (M+5)th column are corrected to set Nth nozzle print data to "0" regardless of whether the original image data at the corresponding pixels are "0" or "1", as shown in FIGS. 14A, 14C, 14E, 14G, 14I and 14K.

Next, image data for Mth to (M+5)th columns of the print performance improving ink print head will be explained.

As shown in FIG. 14A, there are no image data in (N−1)st and (N+1)st nozzles on the Mth column of the color print head. Hence, the print data for the Nth nozzle on the Mth column of the print performance improving ink print head is set to "0", as shown in FIG. 14B.

Next, as shown in FIG. 14C, there are no image data in (N−1)st and (N+1)st nozzles on the (M+1)st column of the color print head. Hence, the print data for the Nth nozzle on the (M+1)st column of the print performance improving ink print head is set to "0", as shown in FIG. 14D.

Next, as shown in FIG. 14E, there is image data in (N−1)st nozzle on the (M+2)nd column of the color print head. Hence, the print data for the Nth nozzle on the (M+1)st, (M+2)nd and (M+3)rd columns of the print performance improving ink print head are set to "1", as shown in FIG. 14F.

Next, as shown in FIG. 14G, there is image data in (N+1)st nozzle on the (M+3)rd column of the color print head. Hence, the print data for the Nth nozzle on the (M+2)nd, (M+3)rd and (M+4)th columns of the print performance improving ink print head are set to "1", as shown in FIG. 14H.

Next, as shown in FIG. 141, there is image data in (N−1)st nozzle on the (M+4)th column of the color print head. Hence, the print data for the Nth nozzle on the (M+3)rd, (M+4)th and (M+5)th columns of the print performance improving ink print head are set to "1", as shown in FIG. 14J.

Next, as shown in FIG. 14K, there are image data in (N−1)st and (N+1)st nozzles on the (M+5)th column of the color print head. Hence, the print data for the Nth nozzle on the (M+4)th, (M+5)th and (M+6)th columns of the print performance improving ink print head are set to "1", as shown in FIG. 14L.

In this way, the similar processing continues to be carried out for the entire image data by printing dots with the color ink and the print performance improving ink.

FIG. 13 shows printed dots according to the color dot print data and the print performance improving ink print data after being corrected in the third embodiment when an Nth nozzle in the color print head fails to eject ink.

As can be seen from the figure, in the Nth nozzle line where the ejection failure has occurred, more print performance improving ink dots are added than in the second embodiment according to the print data for (N−1)st and (N+1)st nozzles in the color print head.

(Fourth Embodiment)

The fourth embodiment of the present invention will be described by referring to FIG. 15 and FIGS. 16A to 16L.

The fourth embodiment is similar to the second or third embodiment in that the print performance improving ink print data for the Nth nozzle line where an ejection failure has occurred is generated according to the print data for (N−1)st and (N+1)st nozzle lines in the color head. What is different in the fourth embodiment is that when there is print data "1" for any of the (N−1)st and (N+1)st nozzles in the color print head, the print performance improving ink print data for the Nth nozzle is set to "1". Further, in the fourth embodiment, when there is print data "1" for the (N−1)st nozzle in the color print head, the print performance improving ink print data for the (N−1)st nozzle is set to "0". When there is print data "1" for the (N+1)st nozzle in the color print head, the print performance improving ink print data for the (N+1)st nozzle is set to "0".

Figure 15:
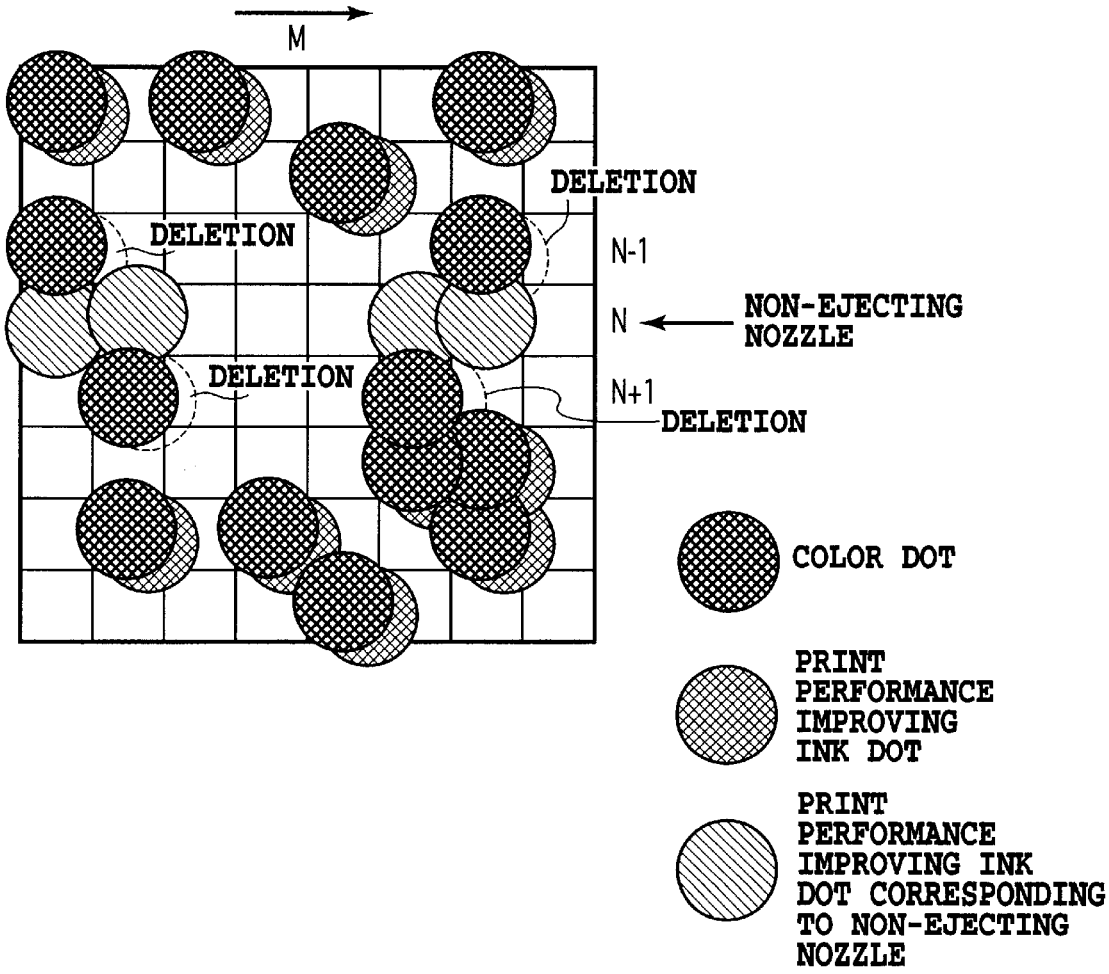
FIG. 15 is a diagram showing dot arrangements of a color ink and a print performance improving ink after the correction processing according to a fourth embodiment of the invention.

In this embodiment, too, a print head 21 is used which ejects ink droplets each measuring 8.5±0.5 pl at a resolution of 600 dpi, as in the second and third embodiments. The compositions of a color ink containing colorant and of a print performance improving ink and a print medium are similar to those of the second and third embodiments. As shown in FIG. 15, the print performance improving ink dots are printed deviated to the lower right by ¼ pixel from the corresponding color ink dots, as in the second embodiment.

In this case, too, the Nth nozzle (in this case, N=16) in the color print head fails to eject ink. Hence, as shown in FIGS. 16A, 16C, 16E, 16G, 16I and 16K, the image data to be given to the color print head which ranges from Mth column to (M+5)th column are corrected to set Nth nozzle print data to "0" (no ejection) regardless of whether the original pixel data at the corresponding pixels are "0" or "1".

Next, the image data for the Mth to (M+5)th columns of the print performance improving ink print head will be explained.

Figures 16A, 16B, 16C, 16D, 16E, 16F, 16G, 16H, 16I, 16J, 16K, 16L:
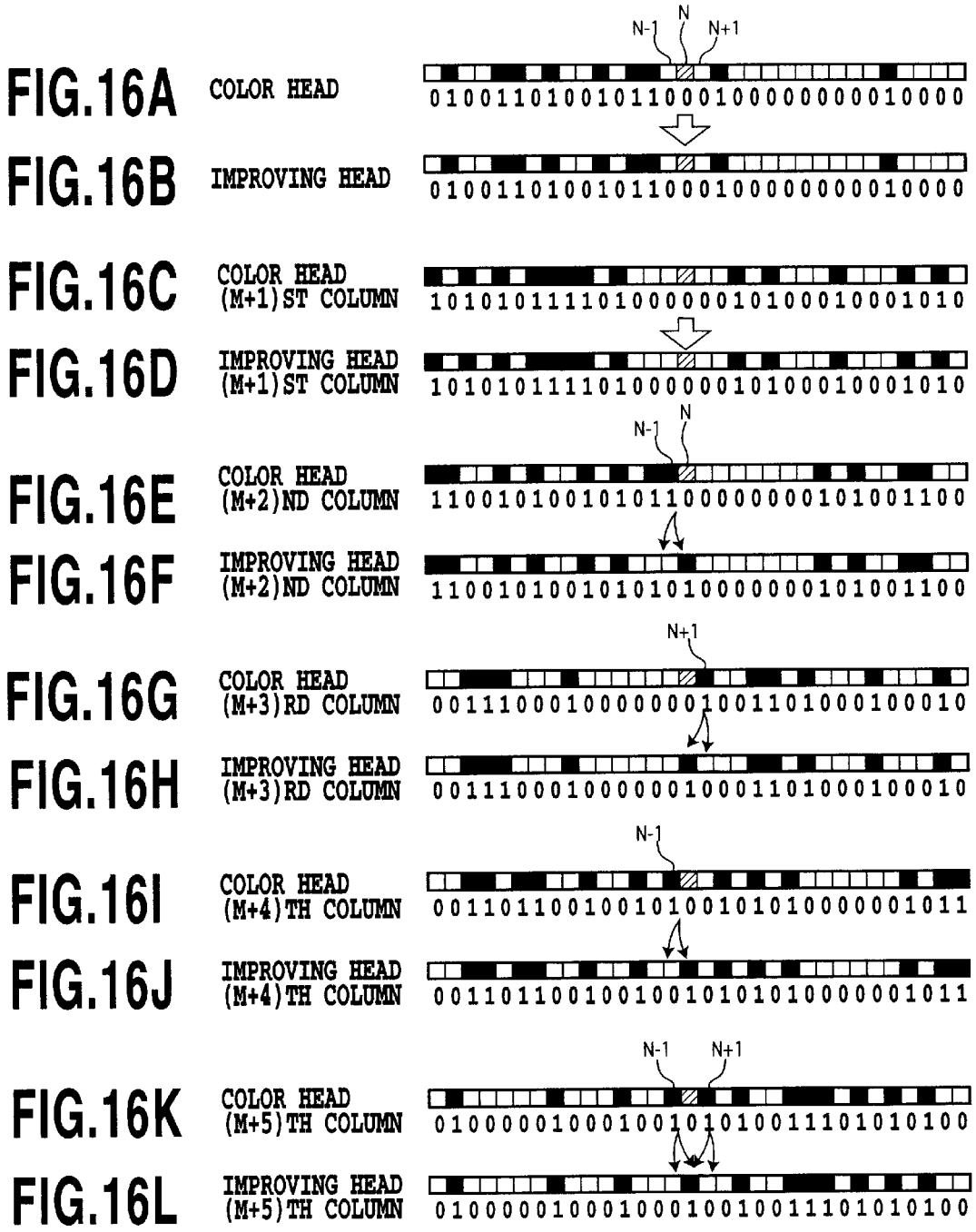
FIGS. 16A to 16L are diagrams showing print data of a color ink and a print performance improving ink before and after the correction processing according to the fourth embodiment of the invention.

As shown in FIG. 16A, there are no image data in (N−1)st and (N+1)st nozzles on the Mth column of the color print head. Hence, the print data for the Nth nozzle on the Mth column of the print performance improving ink print head is set to "0", as shown in FIG. 16B. The print performance improving ink print data for (N−1)st and (N+1)st nozzles are left unchanged at "0".

Next, as shown in FIG. 16C, there are no image data in (N−1)st and (N+1)st nozzles on the (M+1)st column of the color print head. Hence, the print data for the Nth nozzle on the (M+1)st column of the print performance improving ink print head is set to "0", as shown in FIG. 16D. The print performance improving ink print data for (N−1)st and (N+1) st nozzles are left unchanged at "0".

Next, as shown in FIG. 16E, there is image data in (N−1)st nozzle on the (M+2)nd column of the color print head. Hence, the print data for the Nth nozzle on the (M+2)nd column of the print performance improving ink print head is corrected to "1", as shown in FIG. 16F. Further, the print performance improving ink print data for (N−1)st nozzle is changed to "0".

Next, as shown in FIG. 16G, there is image data in (N+1)st nozzle on the (M+3)rd column of the color print head. Hence, the print data for the Nth nozzle on the (M+3)rd column of the print performance improving ink print head is corrected to "1", as shown in FIG. 16H. Further, the print performance improving ink print data for (N+1)st nozzle is changed to "0".

Next, as shown in FIG. 16I, there is image data in (N−1)st nozzle on the (M+4)th column of the color print head. Hence, the print data for the Nth nozzle on the (M+4)th column of the print performance improving ink print head is corrected to "1", as shown in FIG. 16J. Further, the print performance improving ink print data for (N−1)st nozzle is changed to "0".

Next, as shown in FIG. 16K, there are image data in (N−1)st and (N+1)st nozzles on the (M+5)th column of the color print head. Hence, the print data for the Nth nozzle on the (M+5)th column of the print performance improving ink print head is corrected to "1", as shown in FIG. 16L. Further, the print performance improving ink print data for (N−1)st and (N+1)st nozzles are changed to "0".

In this way, the similar processing continues to be carried out for the entire image data by printing dots with the color ink and the print performance improving ink.

FIG. 15 shows printed dots according to the color dot print data and the print performance improving ink print data after being corrected in the fourth embodiment when an Nth nozzle in the color print head fails to eject ink.

As can be seen from the figure, in the Nth nozzle line where the ejection failure has occurred, print performance improving ink dots are selectively added according to the print data for (N−1)st and (N+1)st nozzles in the color print head. It is also seen that print performance improving ink dots are deleted from (N−1)st and (N+1)st nozzle lines according to the print data for (N−1)st and (N+1)st nozzles in the color print head.

(Fifth Embodiment)

Next, the fifth embodiment of the invention will be described by referring to FIG. 17 and FIGS. 18A to 18L.

In the fifth embodiment, it is assumed that an Nth nozzle in the color print head fails to eject ink. When there is print data "1" for an (N−1)st nozzle on an Mth column of the color print head, print performance improving ink print data for (N−1)st nozzle on (M−1)st column, (N−1)st nozzle on Mth column, (N−1)st nozzle on (M+1)st column, Nth nozzle on (M−1)st column, Nth nozzle on Mth column and Nth nozzle on (M+1)st column are corrected to "1". Further, when there is print data "1" for an (N+1)st nozzle on an Mth column of the color print head, print performance improving ink print data for Nth nozzle on (M−1)st column, Nth nozzle on Mth column, Nth nozzle on (M+1)st column, (N+1)st nozzle on (M−1)st column, (N+1)st nozzle on Mth column and (N+1) st nozzle on (M+1)st column are corrected to "1".

Figure 17:
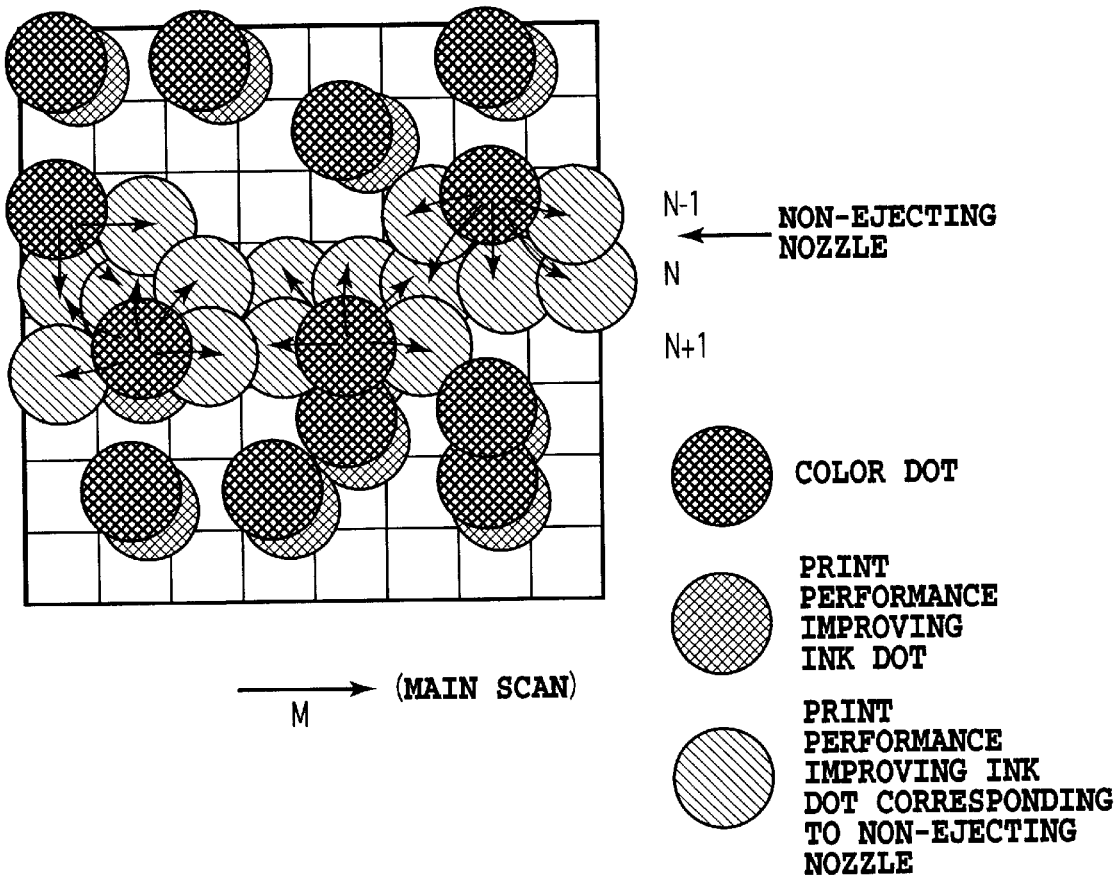
FIG. 17 is a diagram showing dot arrangements of a color ink and a print performance improving ink after the correction processing according to a fifth embodiment of the invention.
Figure 19:
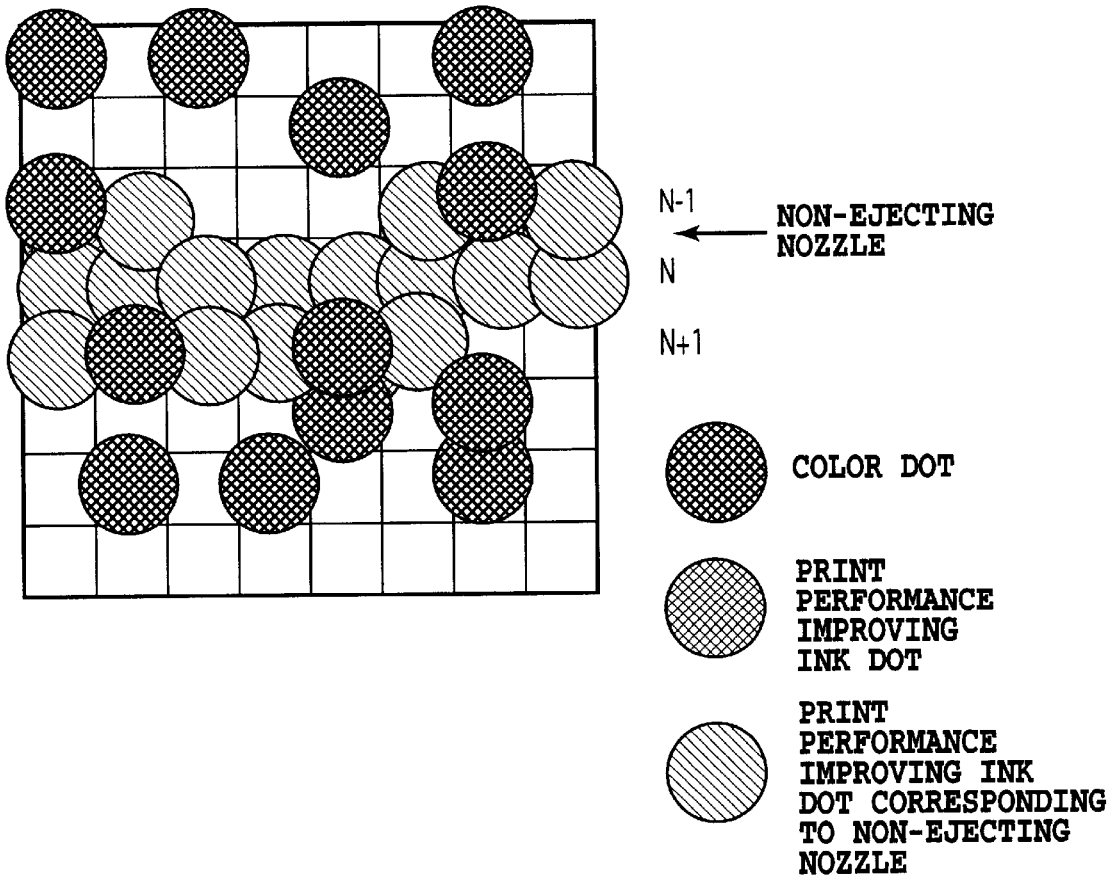
FIG. 19 is a diagram showing dot arrangements of a color ink and a print performance improving ink after the correction processing according to a eighth embodiment of the invention.

In this embodiment, too, a print head 21 is used which ejects ink droplets each measuring 8.5±0.5 pl at a resolution of 600 dpi, as in the second to fourth embodiments. The compositions of a color ink containing colorant and of a print performance improving ink and a print medium are similar to those of the second to fourth embodiments. As shown in FIG. 17, the print performance improving ink dots are printed deviated to the lower right by ¼ pixel from the corresponding color ink dots, as in the second embodiment.

In this case, too, because the Nth nozzle in the color print head (in this case, N=16) is a non-ejecting nozzle, the image data to be given to the color print head which ranges from Mth column to (M+5)th column are corrected to set Nth nozzle print data to "0" regardless of whether the original image data at the corresponding pixels are "0" or "1", as shown in FIGS. 18A, 18C, 18E, 18G, 18I and 18K.

Next, the print performance improving ink image data for the Mth to (M+5)th columns will be explained.

As shown in FIG. 18A, there are no image data in (N−1)st and (N+1)st nozzles on the Mth column of the color print head. Hence, the print data for the Nth nozzle on the Mth column of the print performance improving ink print head is set to "0", as shown in FIG. 18B.

Next, as shown. in FIG. 18C, there are no image data in (N−1)st and (N+1)st nozzles on the (M+1)st column of the color print head. Hence, the print data for the Nth nozzle on the (M+1)st column of the print performance improving ink print head is set to "0", as shown in FIG. 18D.

Next, as shown in FIG. 18E, there is image data in (N−1)st nozzle on the (M+2)nd column of the color print head. Hence, the print data for six pixels of the print performance improving ink—(N−1)th and Nth nozzles on (M+1)st, (M+2)nd and (M+3)rd columns—are corrected to "1", as shown in FIG. 18F.

Next, as shown in FIG. 18G, there is image data in (N+1)st nozzle on the (M+3)rd column of the color print head. Hence, the print data for six pixels of the print performance improving ink—Nth and (N+1)th nozzles on (M+2)nd, (M+3)rd and (M+4)th columns—are corrected to "1", as shown in FIG. 18H.

Next, as shown in FIG. 18I, there is image data in (N−1)st nozzle on the (M+4)th column of the color print head. Hence, the print data for six pixels of the print performance improving ink—(N−1)st and Nth nozzles on (M+3)rd, (M+4)th and (M+5)th columns—are corrected to "1", as shown in FIG. 18J.

Next, as shown in FIG. 18K, there are image data in (N−1)st and (N+1) nozzles on the (M+5)th column of the color print head. Hence, the print data for nine pixels of the print performance improving ink—(N−1)st, Nth and (N+1)st nozzles on (M+4)th, (M+5)th and (M+6)th columns—are corrected to "1", as shown in FIG. 18L.

In this way, the similar processing continues to be carried out for the entire image data by printing dots with the color ink and the print performance improving ink.

FIG. 17 shows printed dots according to the color dot print data and the print performance improving ink print data after being corrected in the fifth embodiment when an Nth nozzle in the color print head fails to eject ink.

As can be seen from this figure, print performance improving ink dots are selectively added to the Nth nozzle line and also to (N−1)st and (N+1)st nozzle lines, immediately before and after the Nth nozzle line, according to the print data for the (N−1)st and (N+1)st nozzles of the color head.

(Sixth Embodiment)

The techniques according to the second to fourth embodiments are evaluated by using three kinds of print mediums. The degree to which blank lines are inconspicuous is rated in three levels—excellent, good and fair.

Technique of second embodiment using PB-Paper: Good

Technique of third embodiment using PB-Paper: Excellent

Technique of fourth embodiment using PB-Paper: Excellent

Technique of fifth embodiment using PB-Paper: Excellent

Technique of second embodiment using HR-101: Good

Technique of third embodiment using HR-101: Good

Technique of fourth embodiment using HR-101: Excellent

Technique of fifth embodiment using HR-101: Excellent

Technique of second embodiment using GP-101: Fair

Technique of third embodiment using GP-101: Fair

Technique of fourth embodiment using GP-101: Good

Technique of fifth embodiment using GP-101: Good

It is seen from the above result that differentiating the mode of application of the print performance improving ink according to the kind of the print medium can optimally prevent the forming of blank lines on a particular print medium.

Another experiment was also performed in which, after the print performance improving ink was printed, a color print head having a failed nozzle performed printing during another scanning. The difference in dot landing time on the print medium between the print performance improving ink and the color ink was 2 seconds. In this case, advantageous effects produced in the preceding embodiments are not observed and no improvements are made on the image quality degradation due to blank lines.

(Seventh Embodiment)

In the seventh embodiment a clear ink with the following composition is used as a print performance improving ink to form printed dots on a non-ejecting nozzle line N by the technique of the fourth embodiment. The print performance improving ink print data other than those for the Nth nozzle are set to "0".

| Clear Ink | |
|---|---|
| Glycerine | 5.0 wt % |
| Thiodiglycol | 5.0 wt % |
| Urea | 5.0 wt % |
| Isopropyl alcohol | 4.0 wt % |
| Acetylenol EH (KawaKen Fine Chemical) | 1.0 wt % |
| Water | 80.0 wt % |

The blank lines were able to be reduced by the technique of the seventh embodiment.

(Eighth Embodiment)

The eighth embodiment uses a color ink, a print performance improving ink and a print medium similar to those used in the second embodiment. In the eighth embodiment, for a black ink, the print performance improving ink is applied to vicinities of those dots that would have been formed by the non-ejecting nozzles and faulty nozzles and also to normal image portions for which there are no non-ejecting or faulty nozzles, as shown in FIG. 17. For cyan, magenta and yellow inks, the print performance improving ink is applied only to the vicinities of those dots that would have been formed by the non-ejecting nozzles and faulty nozzles and not to the normal image portions. With this embodiment, too, a printed image with reduced blank lines was able to be obtained.

(Variation)

In the above embodiments, when an Nth nozzle is abnormal, print performance improving ink print data is generated according to the color ink print data for (N−1)st and (N+1)st nozzles so that the generated improving ink print data adjoins the pixels of the referenced color ink print data. It is also possible to generate print performance improving ink print data based on, for example, the print data for (N−2)nd, (N−1)st, (N+1)st and (N+2)nd nozzles of the color print head. The print performance improving ink may be printed uniformly at a constant density. What is required to realize this invention is that more dots of the print performance improving ink are printed near the color dots adjoining the non-ejecting nozzle line.

In this invention the print performance improving ink may be colorless and clear, or colored. The print performance improving ink may also be a clear ink simply not containing a colorant. It may also be any liquid that can be ejected from an ink nozzle.

As described above, as soon as a color dot and a print performance improving ink contact, the colorant instantly coagulates on a print medium. Hence, a desired effect cannot be expected when the color dot and the adjoining print performance improving ink dot are printed a sufficiently long interval apart. It is therefore preferred that the color ink and the print performance improving ink be brought into contact with each other before one of the inks gets absorbed into paper. Further, in this invention, because it is considered desirable to positively mix the print performance improving ink and the color dot on the print medium, it is preferred that the interval between their landing times be further shortened.

As for the order of printing, the print performance improving ink may first be printed, followed by the color ink, or vice versa. In either case, the landing intervals between these two inks should be such that one of the two inks is ejected well before the other ink that has landed first is completely soaked into the print medium or dried.

While in the above embodiment the sizes of dot matrices of the color dots and the print performance improving ink dots are set equal, they may be differentiated. That is, the output resolution of the color dots is maintained while lowering the output resolution of the print performance improving ink dots. This arrangement can reduce cost involving data processing of the print performance improving ink and cost of the print performance improving ink used on the apparatus.

In this invention, because the print data of the print performance improving ink can be generated using simple image processing, the processing speed can be increased. Although it may cost slightly more, a plurality of light- and dark-colored inks or large- and small-size dots may be used for each color. In this case, the present invention can reproduce a higher order of gray scale on a print medium.

The present invention can be implemented by combining at least one kind of color ink and at least one kind of print performance improving ink. It is also possible to prepare two or more kinds of color ink and two or more kinds of print performance improving ink. In that case, the color ink or the print performance improving ink need only be landed at desired positions on the print medium while the print performance improving ink or the color ink is wet. The color ink may be of any desired color. Alternatively, the invention may be applied to a particular color ink only. In this invention, the most effective system for the inks described above is the one executing the film boiling method described above.

(Others)

While in the embodiments above we have described the construction in which a stepwise print pattern is actually printed on a print medium and checked to detect a non-ejecting or faulty nozzle, this invention can also employ other detection techniques. Further, the present invention can achieve its objective as long as an abnormal nozzle can be identified if a construction for detecting the abnormal nozzle is not provided. For example, a faulty nozzle or failed nozzle can be identified by inputting the result of user's visual check into the printing apparatus either directly or through a driver of a host apparatus connected to the printing apparatus. In a construction having a storage means such as memory installed in the print head, information on each nozzle and information on the failed/faulty nozzles may be stored in the storage means so that the printing apparatus can read these information to identify the failed/faulty nozzles. As for the timing at which such information is stored in the storage means in the print head, information on an initial state may be stored in the storage means at time of shipping or the information may be updated according to the history of use by the user. In the ink jet printing system, the present invention produces an excellent effect when it is applied to a print head and a printing apparatus of a type which has a means for generating a thermal energy for ejecting ink (e.g., electrothermal transducers and laser beams) and which causes a status change in ink by the generated thermal energy. This type of print head and printing apparatus when applying this invention can achieve a higher density and a higher resolution.

A representative and preferred construction and working principle of this type of the ink jet printing system may be found in U.S. Pat. Nos. 4,723,129 and 4,740,796. This type of printing system is applicable to both the so-called on-demand printing and continuous printing. The on-demand printing is particularly advantageous for the following reason. An electrothermal transducer arranged in each sheet or liquid path holding a liquid (ink) is applied at least one drive signal which corresponds to print data and causes a quick temperature rise in excess of a nucleate boiling to generate a thermal energy in the electrothermal transducer which in turn causes a film boiling on a heat acting surface in the print head. As a result, a bubble can be formed in the liquid (ink) in each liquid path in one-to-one correspondence with the drive signal. The growth and contraction of this bubble ejects liquid (ink) through the nozzle opening to form at least one flying droplet. The drive signal can be more advantageously formed in a pulse shape. With a pulse drive signal the bubble can be grown and contracted instantly, realizing a liquid (ink) ejection with an excellent responsiveness. Examples of preferred pulse drive signals include those described in U.S. Pat. Nos. 4,463,359 and 4,345,262. Further improvements can be made by adopting the conditions described in U.S. Pat. No. 4,313,124 related to a rate of temperature rise on the heat acting surface.

The constructions of the print head to which the present invention can be applied include those disclosed in the above-cited specifications in which liquid ejection ports, liquid paths and electrothermal transducers are integrally combined (linear liquid paths or rectangular liquid paths) and those disclosed in U.S. Pat. Nos. 4,558,333 and 4,459,600 in which a heat acting portion is arranged in a bent area. The present invention is also effectively applicable to a construction disclosed in Japanese Patent Laid-open No. 59-123670 in which a common slit to a plurality of electrothermal transducers forms ejection portions of individual electrothermal transducers and also to a construction disclosed in Japanese Patent Laid-open No. 59-138461 in which an opening for absorbing a pressure wave of the thermal energy is formed in each ejection portion. That is, whatever the form of the print head, this invention enables reliable and efficient execution of printing.

Further, the present invention can also be applied effectively to a full-line type print head which has a length matching the maximum printable width of the print medium.

Such a print head may have a construction in which the full length may be provided by a combination of a plurality of print heads or by a single integrally formed print head.

In the serial type described above, the present invention can also be advantageously applied where the print head is fixed to the printing apparatus, where the print head is of a replaceable chip type which, when mounted to the printing apparatus, can establish an electrical connection with, and receive ink from, the apparatus, or where the print head is of a cartridge type which has an integrally formed ink tank.

Adding a print head ejection performance recovery means, a preliminary auxiliary means and others to the printing apparatus of this invention is desirable because they help stabilize the advantageous effect of the invention. Examples of such additional auxiliary means for a print head include a capping means, a cleaning means, a pressurizing or suction means, a preliminary heating means using an electrothermal transducer or a separate heating element or a combination of these, and a preliminary ejection means for ejecting ink for a purpose other than printing.

As for the kind and number of print heads mounted on the printing apparatus, only one print head may be provided for a single color ink, or a plurality of print heads may be used for a plurality of inks of different colors and different density. That is, this invention is very effectively applied to a printing apparatus which has at least one of different print modes, which include a monochrome print mode using a black ink, a mainstream color, a plural color print mode using different colors and a full-color print mode utilizing color mixing, whether the print head is formed as a single integral head or as a combination of multiple heads.

Furthermore, the ink jet printing apparatus of this invention may be used an image output terminal for information processing equipment such as computers, as a copying machine in combination with a reader, and as a facsimile with a function of transmission and reception.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing method for forming an image on a print medium according to input image data by using a color ink print head and a print performance improving ink print head, the color ink print head having a plurality of ink ejection ports arrayed therein, the print performance improving ink print head having a plurality of ink ejection ports arrayed therein, and by ejecting a color ink from the color ink print head and a print performance improving ink from the print performance improving ink print head onto the print medium, the ink jet printing method comprising:

a first step, of identifying an abnormal ink ejection port with a degraded ink ejection state from among the plurality of ink ejection ports of the color ink print head;

a second step, of, based on image data for ink ejection ports in the vicinity of the identified abnormal ink ejection port, determining a dot position, to which the print performance improving ink is to be applied, among dot positions corresponding to the abnormal ink ejection port; and a printing step, of, based on the image data, performing a printing by means of ejecting the color ink onto dot positions other than the dot positions corresponding to the abnormal ink ejection port and ejecting the print performance improving ink to the dot position determined in the second step, wherein the print performance improving ink improves a printing performance of the color ink by mixing and reacting with the color ink.

2. The ink jet printing method according to claim 1, wherein the second step includes selecting, based on image data for ink ejection ports in the vicinity of the abnormal ink ejection port, a dot position, to which the print performance improving ink is to be applied, on a print line corresponding to the abnormal ink ejection port and on at least one print line each immediately before and after the abnormal print line, and applying the print performance improving ink to the selected print position.

3. The ink jet printing method according to claim 1, wherein the second step includes selecting, based on image data for ink ejection ports in the vicinity of the abnormal ink ejection port, a dot position to be printed by the print performance improving ink print head which corresponds in a main scan direction position to the dot position to be printed by the color ink print head, and applying the print performance improving ink to the selected dot position.

4. The ink jet printing method according to claim 1, wherein the second step includes selecting, based on image data for ink ejection ports in the vicinity of the abnormal ink ejection port, a first dot position to be printed by the print performance improving ink print head which corresponds in a main scan direction position to the dot position to be printed by the color ink print head and a plurality of second dot positions to be printed by the print performance improving ink print head which adjoin the first dot position in the main scan direction, and applying the print performance improving ink to the selected dot positions.

5. The ink jet printing method according to claim 1, wherein a mode of application of the print performance improving ink is differentiated according to a kind of the color ink, a kind of the print performance improving ink and a kind of the print medium.

6. The ink jet printing method according to claim 1, wherein the print performance improving ink is applied only to a print line corresponding to the abnormal ink ejection port and to a vicinity of the print line and is not applied to other portions.

7. The ink jet printing method according to claim 1, wherein when a multipass printing is performed which scans the color ink print head a plurality of times over a predetermined area of the print medium to form an image, printing of print dots by the color ink print head and printing by the print performance improving ink print head of print dots that are to be brought into contact with the color ink dots are performed in the same scan.

8. The ink jet printing method according to claim 1, wherein printing of print dots by the color ink print head and printing by the print performance improving ink print head of print dots that are to be brought into contact with the color ink dots are performed in a preset time interval.

9. The ink jet printing method according to claim 1, wherein the first step comprises:

a pattern forming step, of forming a predetermined print pattern on the print medium by ejecting an ink onto the print medium from ink ejection ports of the color ink print head; and a decision step, of determining the abnormal ink ejection port by reading the predetermined print pattern.

10. The ink jet printing method according to claim 1, wherein each of the print heads generates a bubble by giving heat to the ink and ejects the ink by the generated bubble.

11. An ink jet printing apparatus for forming an image on a print medium according to input image data by using a color ink print head and a print performance improving ink print head, the color ink print head having a plurality of ink ejection ports arrayed therein, the print performance improving ink print head having a plurality of ink ejection ports arrayed therein, and by ejecting a color ink from the color ink print head and a print performance improving ink from the print performance improving ink print head onto the print medium, the ink jet printing apparatus comprising:

identifying means for identifying an abnormal ink ejection port with a degraded ink ejection state from among the plurality of ink ejection ports of the color ink print head; and control means for, based on image data for ink ejection ports in the vicinity of the identified abnormal ink ejection port, determining a dot position, to which the print performance improving ink is to be applied, among dot positions corresponding to the abnormal ink ejection port and, based on the image data, controlling to eject the print performance improving ink to the determined dot position during a printing operation performed by ejecting the color ink onto dot positions other than the dot positions corresponding to the abnormal ink ejection port, wherein the print performance improving ink improves a printing performance of the color ink by mixing and reacting with the color ink.

12. The ink jet printing apparatus according to claim 11, further comprising a decision means for determining the abnormal ink ejection port based on a result of reading a predetermined print pattern, the predetermined print pattern being formed on the print medium by ejecting an ink onto the print medium from ink ejection ports of the color ink print head, wherein the identifying means identifies the abnormal ink ejection port based on the decision result of the decision means.

* * * * *